US006884113B1

(12) United States Patent
Montena

(10) Patent No.: US 6,884,113 B1
(45) Date of Patent: Apr. 26, 2005

(54) APPARATUS FOR MAKING PERMANENT HARDLINE CONNECTION

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 2 days.

(21) Appl. No.: 10/686,204

(22) Filed: Oct. 15, 2003

(51) Int. Cl.[7] ..... H01R 9/05
(52) U.S. Cl. ..... 439/578; 439/584
(58) Field of Search ..... 439/578, 583, 439/584, 585, 271, 654

(56) References Cited

U.S. PATENT DOCUMENTS

| | | | | |
|---|---|---|---|---|
| 3,184,706 | A * | 5/1965 | Atkins | 439/584 |
| 3,208,033 | A | 9/1965 | Blonder | |
| 3,321,732 | A | 5/1967 | Forney, Jr. | |
| 3,354,420 | A | 11/1967 | Mineck | |
| 3,534,322 | A | 10/1970 | Hoffa | |
| 3,624,679 | A | 11/1971 | Ziegler, Jr. | |
| 3,681,739 | A | 8/1972 | Kornick | |
| 3,685,006 | A | 8/1972 | Jerrold-Jones | |
| 4,135,288 | A | 1/1979 | Pitschi | |
| 4,557,546 | A | 12/1985 | Dreyer | |
| 4,668,043 | A | 5/1987 | Saba et al. | |
| 4,676,577 | A * | 6/1987 | Szegda | 439/584 |
| 4,688,877 | A | 8/1987 | Dreyer | |
| 5,002,503 | A | 3/1991 | Campbell et al. | |
| 5,340,332 | A * | 8/1994 | Nakajima et al. | 439/584 |
| 5,439,386 | A | 8/1995 | Ellis et al. | |
| 5,528,973 | A | 6/1996 | Pfenning et al. | |
| 5,586,910 | A * | 12/1996 | Del Negro et al. | 439/584 |
| 5,863,220 | A * | 1/1999 | Holliday | 439/584 |
| 6,080,015 | A * | 6/2000 | Andreescu | 439/584 |
| 6,231,357 | B1 | 5/2001 | Rumsey | |
| 6,309,251 | B1 | 10/2001 | Tang | |
| 6,331,123 | B1 | 12/2001 | Rodrigues | |
| 6,716,061 | B2 * | 4/2004 | Pitschi et al. | 439/578 |
| 6,733,336 | B1 * | 5/2004 | Montena et al. | 439/578 |
| 2004/0102088 | A1 * | 5/2004 | Bence et al. | 439/578 |

* cited by examiner

*Primary Examiner*—Tho D. Ta
(74) *Attorney, Agent, or Firm*—Wall Marjama & Bilinski LLP

(57) ABSTRACT

A permanent connector interconnects a hard-line coaxial cable to a connection housing. A contact is interconnected with and extends coaxially through a connector body. A collet one-piece with the contact receives a central conductor of the coaxial cable, while a sealing member and mandrel receive an outer conductor of the coaxial cable between them. A compression body positioned radially adjacent a portion of the connector body moves axially between first and second positions, wherein when the compression body is in its first position, the coaxial cable is removable from within the connector, and when the compression body is in its second position, the coaxial cable is not removable from within the connector. The compression body acts indirectly upon the sealing member so that an electrical connection is made between the sealing member and the outer conductor of the cable when the compression body is in its second position.

22 Claims, 23 Drawing Sheets

APPARATUS FOR MAKING PERMANENT HARDLINE CONNECTION

FIELD OF THE INVENTION

The present invention relates generally to coaxial cable connectors, and more particularly to such connectors used with hard-line coaxial cables.

BACKGROUND OF THE INVENTION

Coaxial cable is a typical transmission medium used in communications networks, such as a CATV network. The cables which make up the transmission portion of the network are typically of the "hard-line" type, while those used to distribute the signals into residences and businesses are typically "drop" connectors. The principal difference between hard-line and drop cables, apart from the size of the cables, is that hard-line cables include a rigid or semi-rigid outer conductor, typically covered with a weather protective jacket, that effectively prevents radiation leakage and protects the inner conductor and dielectric, while drop connectors include a relatively flexible outer conductor, typically braided, that permits their bending around obstacles between the transition or junction box and the location of the device to which the signal is being carried, i.e., a television, computer, and the like, but that is not as effective at preventing radiation leakage. Hard-line conductors, by contrast, generally span considerable distances along relatively straight paths, thereby virtually eliminating the need for a cable's flexibility. Due to the differences in size, material composition, and performance characteristics of hard-line and drop connectors, there are different technical considerations involved in the design of the connectors used with these types of cables.

In constructing and maintaining a network, such as a CATV network, the transmission cables are often interconnected to electrical equipment that conditions the signal being transmitted. The electrical equipment is typically housed in a box that may be located outside on a pole, or the like, or underground that is accessible through a cover. In either event, the boxes have standard ports to which the transmission cables may be connected. In order to maintain the electrical integrity of the signal, it is critical that the transmission cable be securely interconnected to the port without disrupting the ground connection of the cable. This requires a skilled technician to effect the interconnection.

A typical type of interconnect device used to connect a transmission cable to an equipment port is the threaded type. The technician must prepare the cable in the standard manner, i.e., stripping the various layers of the cable to their predetermined distances and furrowing out the dielectric material over a predetermined distance in order to bottom out the inner conductor until it is seized by the conductive pin that will carry the signal through the port, and use a wrench to provide torque that will radially compress and seal portions of the connector into the outer jacket of the transmission cable. A wrench is also used to advance a nut positioned at the port end of the connector body onto the port, thereby interconnecting the transmission cable to the equipment port. Such types of connector rely heavily on the skill of the technician in applying the proper amount of torque to effect the connections, thereby making reliability of signal integrity a concern.

In addition to the need for a skilled technician in effecting the connection between the transmission cable and the equipment port, such threaded connectors often require that the transmission cable be severed from the connector and the connector replaced each time the equipment housed in the box needs to be serviced or maintained. Hence, by repeatedly shortening the effective length of the transmission cable due to the severing required to detach the cable from the port, additional parts, such as extenders, must be employed which add to the difficulty of properly interconnecting the cable. It also is difficult to fit a wrench into the space provided by many equipment ports, thereby making the technician's job that uses threaded connectors even more difficult.

Another type of standard connector used with transmission cables are the crimping type. With crimp connectors, the technician uses a crimping tool that radially surrounds the connector after the cable has been bottomed out therein, and radially crimps the connector body into engagement with the cable's outer jacket. While such connectors eliminate the difficulties associated with the threaded connectors, the crimping action often produces inconsistent electrical connection between the connector and the cable, also degrading the cable's outer conductor, thereby creating signal losses that ultimately reduce the quality of the signal being transmitted.

Another type of connector usable on hard-line cables is the compression type connector, such as is disclosed in U.S. Pat. No. 6,331,123. Compression connectors utilize a compression member that is axially slidable into the connector body for radially displacing connecting and sealing members into engagement with the hard-line cable's outer conductor. A compression tool that slides the compression body into the connector is utilized by the technician to effect the connection, and due to the physical constraints of the compression member and connector body, it is impossible for the technician to use too much force to effect the interconnection. Thus, compression connectors eliminate the assembly drawbacks associated with threaded, and to some degree, crimp type connectors.

SUMMARY OF THE INVENTION

Briefly stated, a permanent connector interconnects a hard-line coaxial cable to a connection housing. A contact is interconnected with and extends coaxially through a connector body. A collet one-piece with the contact receives a central conductor of the coaxial cable, while a sealing member and mandrel receive an outer conductor of the coaxial cable between them. A compression body positioned radially adjacent a portion of the connector body moves axially between first and second positions, wherein when the compression body is in its first position, the coaxial cable is removable from within the connector, and when the compression body is in its second position, the coaxial cable is not removable from within the connector. The compression body acts indirectly upon the sealing member so that an electrical connection is made between the sealing member and the outer conductor of the cable when the compression body is in its second position.

In other words, a connector used to interconnect a hard-line coaxial cable to an equipment port includes a main connector body in which the various connecting and sealing members are housed, and a compression body attached to the connector body for axial, sliding movement between first and second positions relative to the connector body. The port side of the connector includes a conductive pin extending axially outwardly therefrom that is adapted to be inserted into the port provided in the equipment box, while an axially extending bore is formed through the cable side of the connector and compression bodies for receiving the central conductor of the hard-line cable therein. A collet electrically connected to the conductive pin seizes the central conductor when it is fully inserted through the axial bore, thereby electrically interconnecting the conductor to the conductive pin that ultimately carries the signal to/from the equipment mounted in the box.

Once the central conductor is fully inserted in the axial bore, the outer conductor of the hard-line cable is positioned annularly between a mandrel that is housed within the connector body and various clamping and sealing members. A compression tool, well known in the industry, is then be used by a technician to axially slide the compression body into the connector body. As the compression body slides into the connector body its ramped, leading face engages a correspondingly ramped surface of a clamping and sealing member. The co-acting ramped surfaces cause the clamping and sealing member to deflect radially inwardly until it contacts the outwardly facing surface of the outer conductor and/or the jacket coating the outer conductor, depending on the type of cable and the amount of jacket coating stripped from the cable end. The flat leading edge of the compression body then engages an RF seal driver that is slidably positioned within the connector body. The RF seal driver includes a ramped surface that engages a corresponding ramped surface of an RF seal. As the RF seal driver slides axially in the connector body, as a result of being pushed by the compression body, its ramped surface causes the RF seal to be forced radially inwardly towards the outwardly facing surface of the hard-line cable's outer conductor. Upon termination of the axial movement of the compression body, the hard-line cable's outer conductor is sandwiched between at least the RF seal and the mandrel.

The inwardly facing surface of the clamping and sealing member that engages the outer conductor is generally flat, thereby creating a continuous seal along its entire width. It is contemplated, however, that this surface of the sealing member could include different geometries, such as a wavy geometry that would create numerous seals, staggered along the width of the member, as opposed to one continuous seal.

Various alternate embodiments of the present invention employ the compression mechanism and the various sealing and clamping mechanisms in connectors for other types of cables and applications, such as splicing together two separate lengths of hard-line cable.

According to an embodiment of the invention, a device for permanently interconnecting a hard-line coaxial cable to a connection housing includes, wherein the coaxial cable includes at least a central conductor, a layer of dielectric material covering the central conductor, and an outer conductor composed of hard-line material, a connector body extending along a longitudinal axis; a contact interconnected to and extending coaxially through the connector body; a collet one-piece with the contact for receiving the central conductor of the coaxial cable; a compression body positioned radially adjacent a portion of the connector body for axial movement relative thereto between first and second positions, wherein when the compression body is in its first position, the coaxial cable is removable from within the device, and when the compression body is in its second position, the coaxial cable is not removable from within the device; a mandrel housed within the connector body, and positioned in contacting relation to an inwardly facing surface of the outer conductor when the compression body is in its second position; and a sealing member housed within the connector body and in engaged relation to the compression body, the sealing member being positioned in sealing relation to an outwardly facing surface of the outer conductor when the compression body is in its second position.

According to an embodiment of the invention, a device for permanently interconnecting a hard-line coaxial cable to a connection housing includes, wherein the coaxial cable includes at least a central conductor, a layer of dielectric material covering the central conductor, and an outer conductor composed of hard-line material, a connector body extending along a longitudinal axis; a contact interconnected to and extending coaxially through the connector body; a collet one-piece with the contact for receiving the central conductor of the coaxial cable; a compression body positioned radially adjacent a portion of the connector body for axial movement relative thereto between first and second positions, wherein when the compression body is in its first position, the coaxial cable is removable from within the device, and when the compression body is in its second position, the coaxial cable is not removable from within the device; a mandrel housed within the connector body, and positioned in contacting relation to an inwardly facing surface of the outer conductor when the compression body is in its second position; and means for clamping and/or sealing the outer conductor to the mandrel.

According to an embodiment of the invention, a splice connector for permanently interconnecting two hard-line coaxial cables, wherein each coaxial cable includes at least a central conductor, a layer of dielectric material covering the central conductor, and an outer conductor composed of hard-line material, includes a connector body extending along a longitudinal axis; a contact interconnected to and extending coaxially through the connector body; first and second collets one-piece with the contact for receiving the central conductors of the coaxial cables; first and second compression bodies positioned radially adjacent first and second portions of the connector body for axial movement relative thereto between first and second positions, wherein when each compression body is in its first position, the coaxial cables are removable from within the splice connector, and when each compression body is in its second position, the coaxial cables are not removable from within the splice connector; first and second mandrels housed within the connector body, and each mandrel positioned in contacting relation to an inwardly facing surface of the respective outer conductors when the compression bodies are in their second position; and first and second sealing members housed within the connector body and in engaged relation to respective compression bodies, the sealing members being positioned in sealing relation to an outwardly facing surface of the respective outer conductor when the compression bodies are in their second position.

According to an embodiment of the invention, a splice connector for permanently interconnecting two hard-line coaxial cables, wherein each coaxial cable includes at least a central conductor, a layer of dielectric material covering the central conductor, and an outer conductor composed of hard-line material, includes a connector body extending along a longitudinal axis; a contact interconnected to and extending coaxially through the connector body; first and second collets one-piece with the contact for receiving the central conductors of the coaxial cables; first and second compression bodies positioned radially adjacent first and second portions of the connector body for axial movement relative thereto between first and second positions, wherein when each compression body is in its first position, the coaxial cables are removable from within the splice connector, and when each compression body is in its second position, the coaxial cables are not removable from within the splice connector; first and second mandrels housed within the connector body, and each mandrel positioned in contacting relation to an inwardly facing surface of the respective outer conductors when the compression bodies are in their second position; and means for clamping and/or sealing the outer conductors to respective ones of the mandrels.

DETAILED DESCRIPTION OF THE PREFERRED EMBODIMENT

Figure 1:
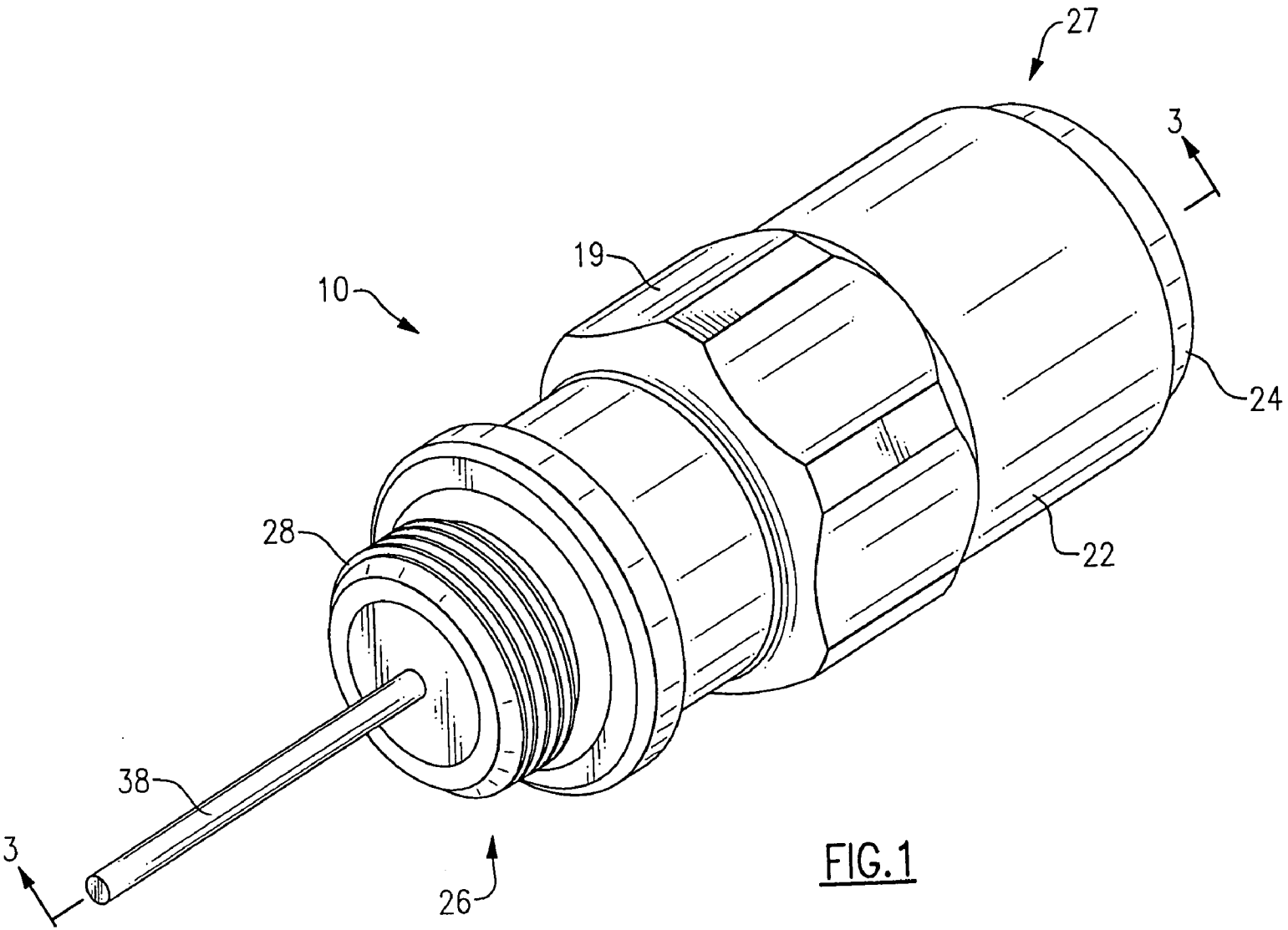
FIG. 1 is a perspective view of a first embodiment of a pin connector.
Figure 5A:
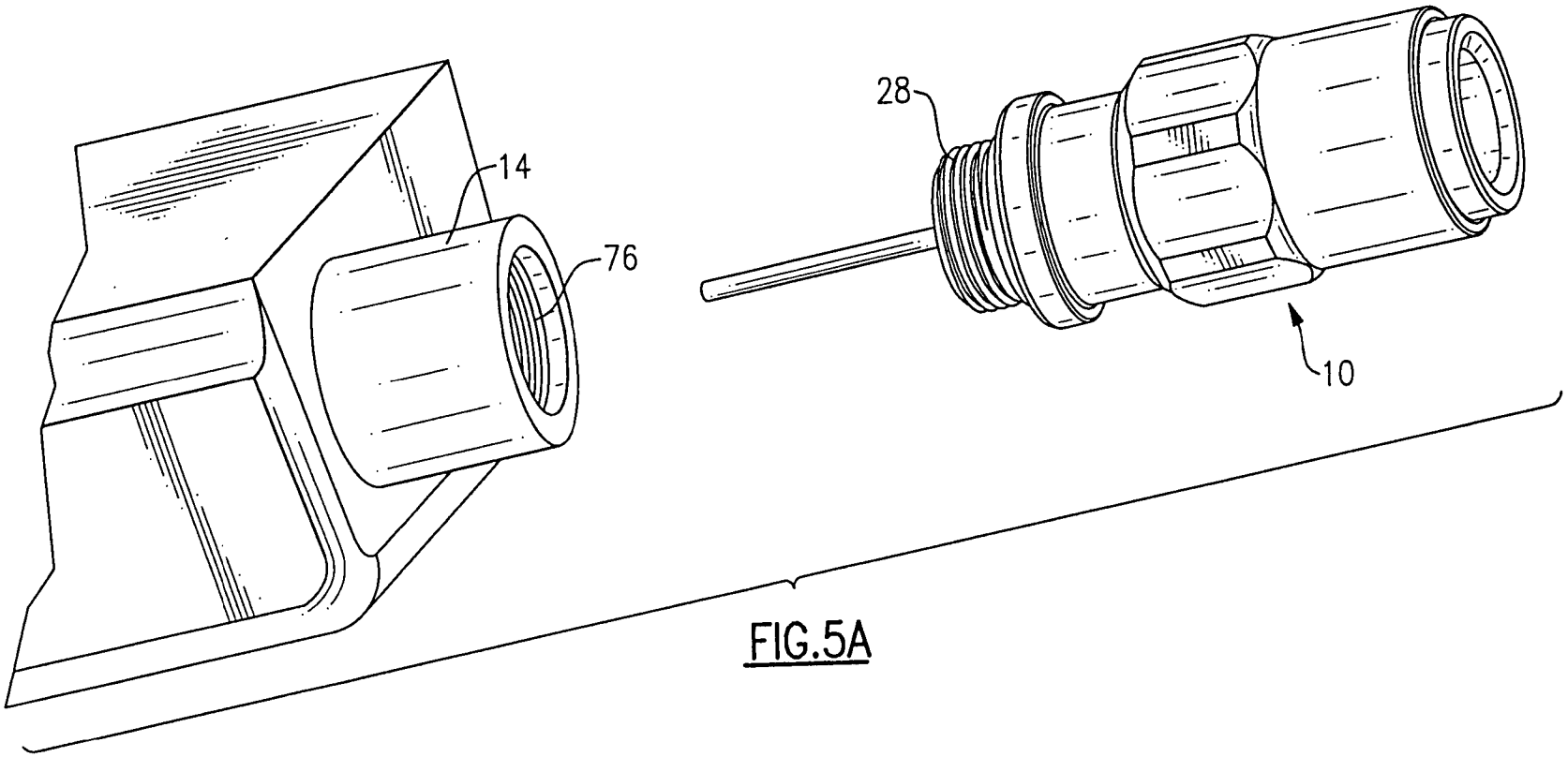
FIGS. 5A–5E are sequential perspective views illustrating the process of connecting the connector of FIG. 1 to an equipment port.
Figure 5B:
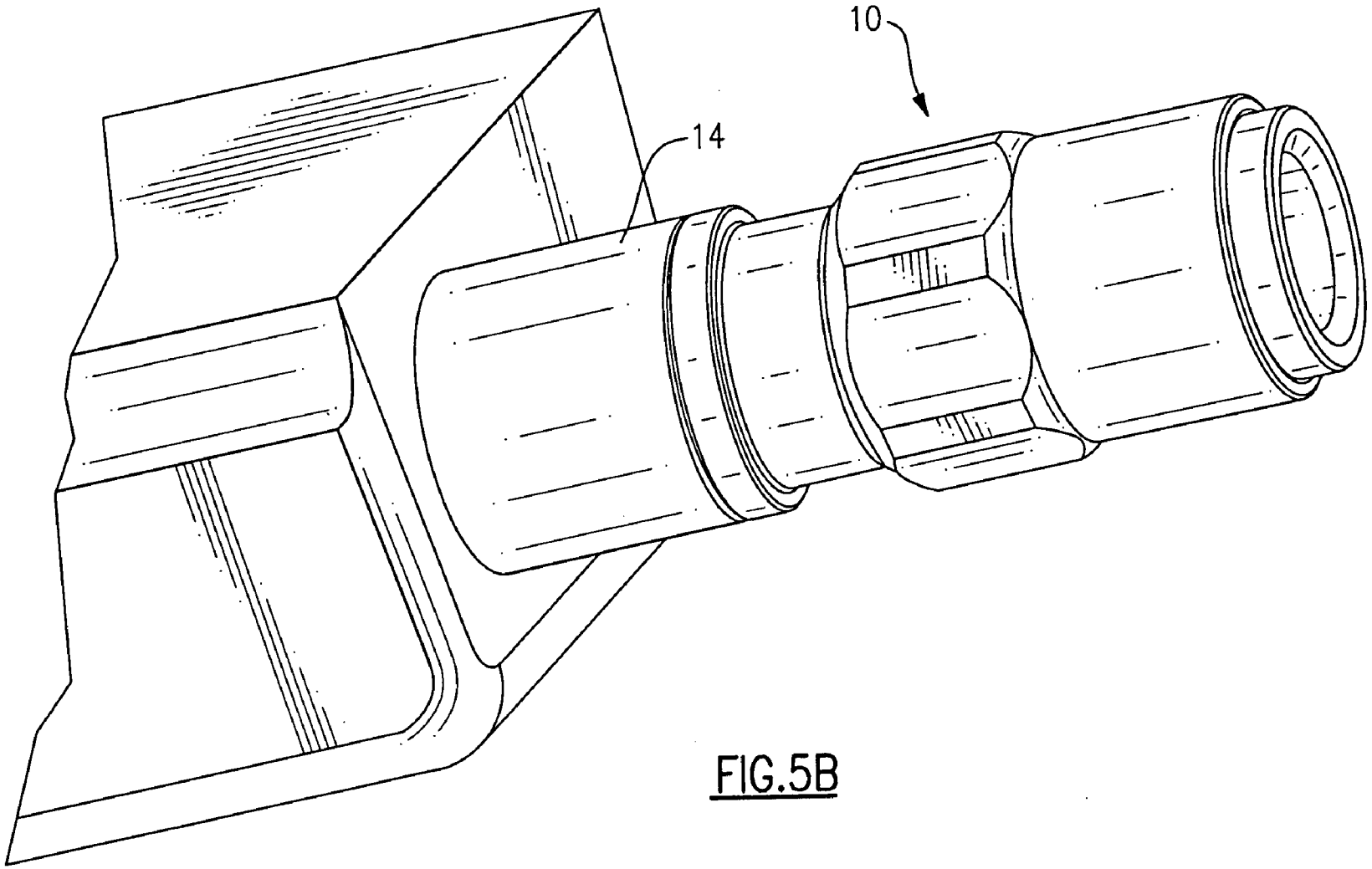
Figure 5C:
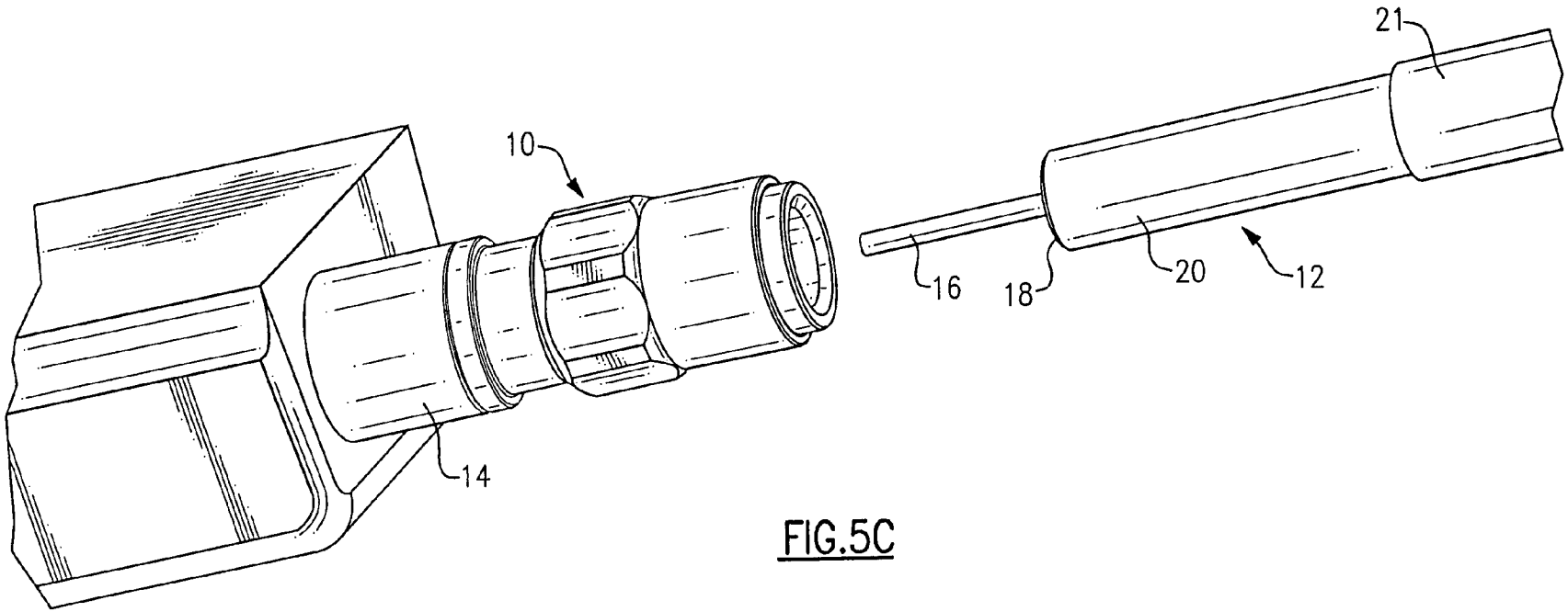

Referring now to the drawings, wherein like reference numerals refer to like parts throughout, and especially to FIGS. 1 and 5C, a first embodiment of a connector 10 interconnects a hard-line coaxial cable 12 to an equipment port 14. Hard-line coaxial cable 12 generally includes a central conductor 16 for carrying a signal, such as a CATV signal, a layer of dielectric material 18 covering central conductor 16, and an outer conductive member 20 composed of conventional hard-line material spaced from central conductor 16 by dielectric 18. A jacket 21 may coat outer conductor 20 to protect it from the weather. Equipment port 14 may be any conventional type of port in which signal processing/conditioning equipment is stored and to which hard-line cables are traditionally interconnected, such as, for example, a tap, amplifier, filter, trap, or the like. Hard-line coaxial cables are typically used as transmission lines in a CATV system, or the like.

Connector 10 includes a connector body 22 preferably having a knurled portion 19 to aid in screwing and/or unscrewing connector 10 from equipment port 14. Connector body 22 includes a first end 26 having external threads 28 for connecting to port 14, and a second end 27 which fits over an end portion of coaxial cable 12. Connector body 22 is hollow so as to receive other elements which constitute connector 10. A conductive pin 38 extends through first end 26 for connection with equipment port 14. An O-ring 78 is positioned against a flange 80 at first end 26.

Figure 2:
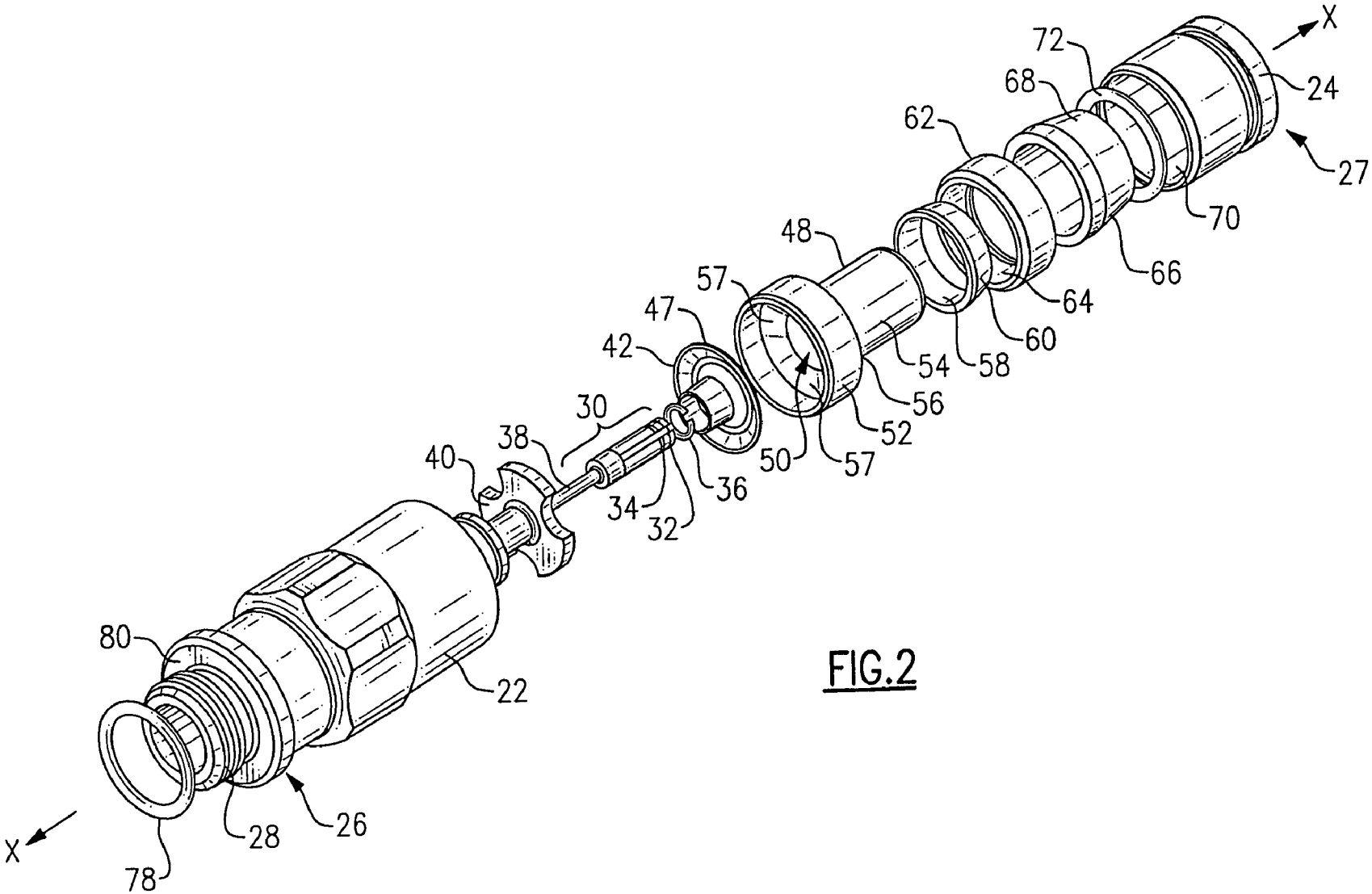
FIG. 2 is an exploded perspective view of the embodiment of FIG. 1.
Figure 3:
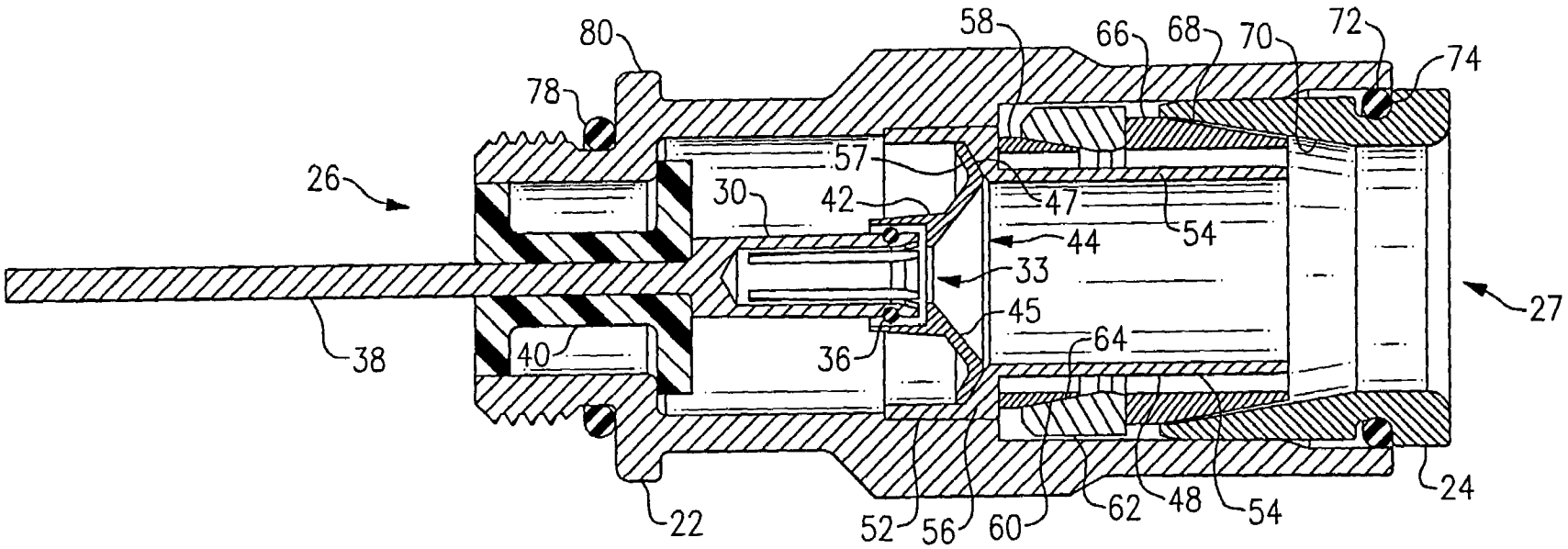
FIG. 3 is a cross-sectional view taken along line 3—3 of FIG. 1.

Referring also to FIG. 2, a compression body 24 is interconnected to connector body 22 for sliding movement between first and second positions along an axis X. Conductive pin 38 is part of a contact 30 which extends axially through first end 26 of body 22. Contact 30 also includes a collet 32 positioned along axis X within body 22 which includes a series of spring biased fingers that extend rearward along axis X to collectively define an annular opening 33 (FIG. 3A) for receiving central conductor 16 of coaxial cable 12. An annular groove 34 is formed in the fingers of collet 32 to hold a spring clip 36 to provide a radially inward bias force to the fingers. Conductive pin 38 is maintained in position by an insulator 40 that is positioned around pin 38 and securely maintained in position by an inner surface of first end 26 of body 22.

A coaxial cable centering guide 42 is positioned rearwardly adjacent collet 32 and includes a central opening 44 (FIG. 3A) with a concave surface 45 that guides central conductor 16 into engaging relation with collet 30. "Rearwardly" refers to the direction extending from first end 26 to second end 27, where first end 26 connects to equipment port 14 and second end 27 connects to cable 12. Guide 42 further includes a shaped portion 47. A mandrel 48 which includes a central opening 50 oriented along axis X includes a first body portion 52 of a first diameter which is slightly greater than the diameter of guide 42. First body portion 52 is positioned in circumferentially surrounding relation to guide 42, while a second body portion 54, of a second diameter smaller than the first diameter, extends rearward from a neck 56 that joins first body portion 52 to second body portion 54. Neck 56 includes an inner surface 57 that is contoured to and abuts shaped portion 47 of guide 42. An RF seal 58, positioned radially around second body portion 54, includes an outer tapering surface 60. An RF seal driver 62 includes an inwardly tapering surface 64 adapted to engage outer tapering surface 60 of RF seal 58 as compression body 24 moves from its first, open position (FIG. 3) towards its second, closed position.

A clamping/sealing member 66, which includes a tapered outer surface portion 68, is positioned rearwardly of RF seal driver 62. Compression body 24 includes a tapered inner surface portion 70 that engages tapered surface portion 68 to produce a radially inward force against tapered surface 68 of clamping/sealing member 66 as compression body 24 moves from its first position (FIG. 3) towards its second position. An O-ring 72 is positioned in an annular groove 74 formed in compression body 24 adjacent second end 27.

Figure 4:
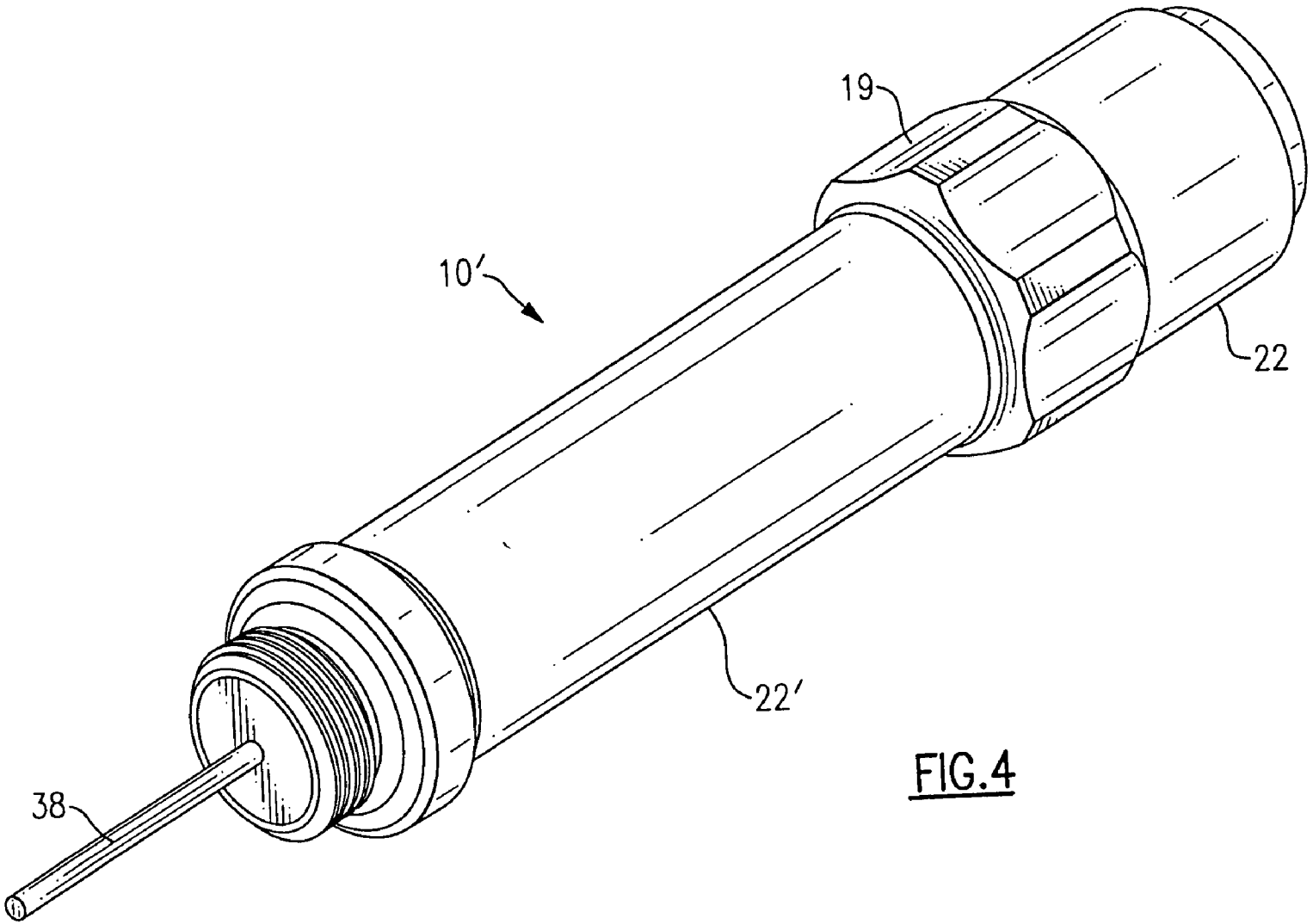
FIG. 4 is a perspective view of the embodiment of FIG. 1 with an extended body section.

Referring to FIG. 4, an alternate embodiment includes a connector 10' which is functionally the same as connector 10, but has an extended connector body 22'. This embodiment is used when cable 12 is too short from previous cuttings and connector replacements to allow the first embodiment to be used. The extra length of this embodiment permits a cable that is otherwise too short to be fitted with this type connector.

Figure 5D:
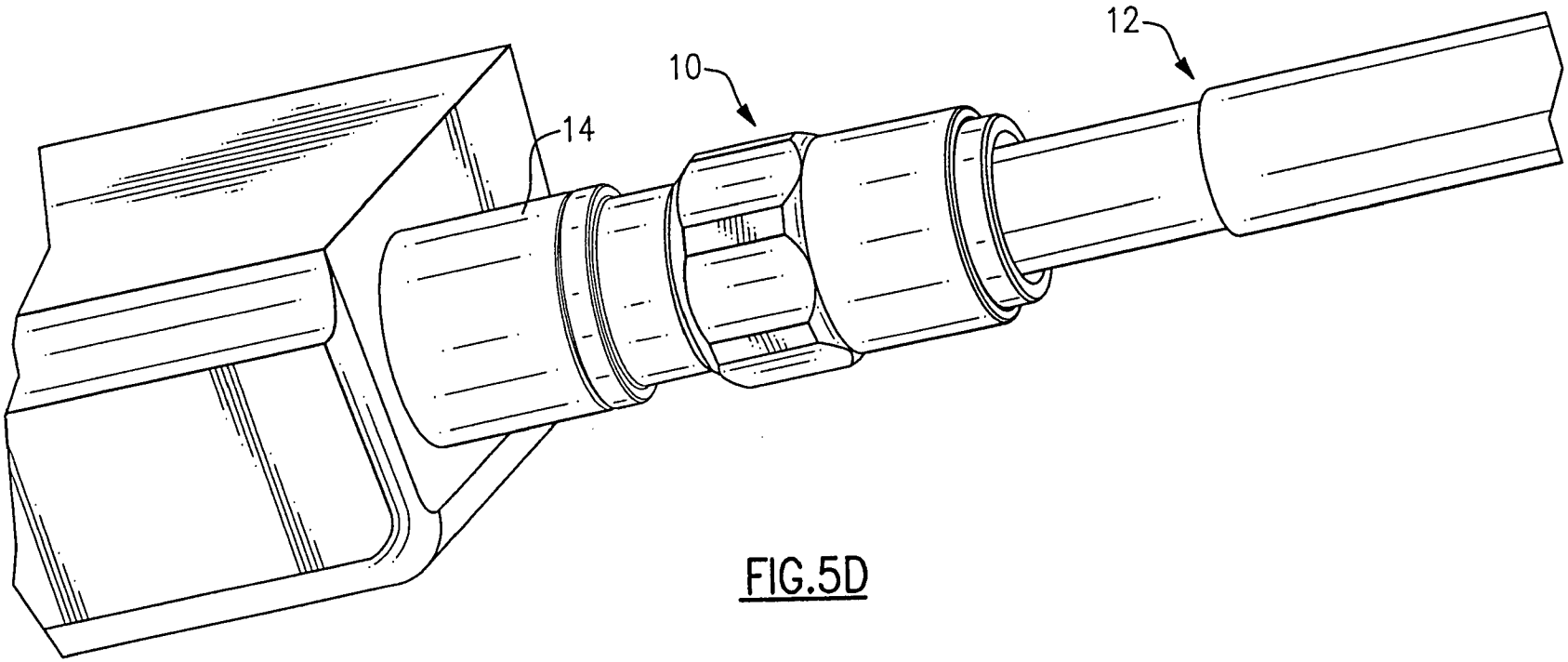
Figure 5E:
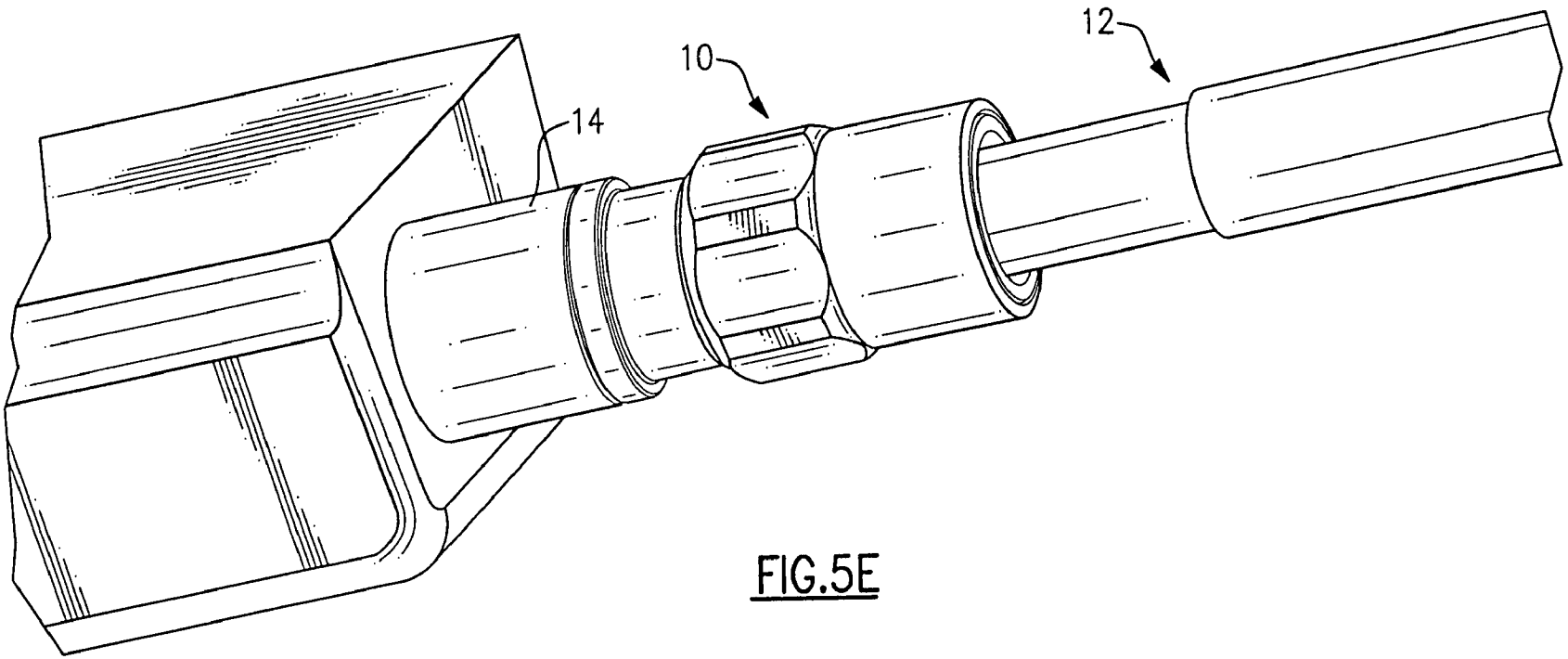

Referring to FIGS. 5A–5E, during installation a technician first trims conductive pin 38 until it extends outward from first end 26 of connector body 22 a predetermined distance that is appropriate for the type of port 14 into which it is to be inserted (FIG. 5A). Connector body 22 is then tightened onto port 14 by advancing external (male) male threads 28 into internal (female) threads 76 present in port 14, until pin 38 is seized in port 14 (FIG. 5B). Cable 12 is then prepared by stripping off predetermined lengths of material to expose a predetermined length of central conductor 16 at the end of cable 12, coring out a predetermined length of dielectric, and exposing a predetermined length of outer conductor 20 (FIG. 5C). Central conductor 16 is then bottomed out in connector body 22 until it is seized between the fingers of collet 32 (FIG. 5D). Spring clip 36 ensures that conductor 16 is force fit between the fingers of collet 32 and ensures that electrical contact with collet 32 is maintained. Outer conductor 20 is concurrently positioned radially between second body portion 54 of mandrel 48, RF seal 58, and clamping/sealing member 66. Compression body 24 is then engaged by a conventional compression tool (not shown), and axially compressed towards connector body 22 until it terminates in its second position (FIG. 5E).

While compression body 24 is being moved from its first position (FIG. 3A) towards its second position (FIG. 3B), its tapered inner surface 70 engages and produces a radially inward force to tapered outer surface 68 of clamping/sealing member 66, thereby causing clamping/sealing member 66 to radially deform and contact the outer surface of outer conductor 20, as well as a portion of jacket 21 depending on the length of jacket 21 which has been stripped from outer conductor 20. After fully passing over clamping/sealing member 66, the leading face of compression body 24 squarely engages RF seal driver 62, moving it axially towards first end 26 of connector body 22. As RF seal driver 62 moves axially, its tapered inner surface 64 engages the tapered outer surface 60 of RF seal 58, thereby causing RF seal 58 to deform radially inward until it contacts outer conductor 20 and sandwiches it against second body member 54 of mandrel 48.

Once compression body 24 is fully inserted in connector body 22, RF seal driver 62 engages neck 56 of mandrel 48, thereby prohibiting any additional axial movement of compression body 24. When in this second position, O-ring 72 positioned in annular groove 74 (FIG. 3A) formed in compression body 24 adjacent second end 27 becomes sealingly positioned between compression body 24 and connector body 22 adjacent their terminal ends, while RF seal 58 is in contacting relation to the outer surface of outer conductor 20 working to prevent unwanted RF leakage from occurring during signal transmission, while clamping/sealing member 66 contacts outer conductor 20, and perhaps jacket 21, preventing undesirable movement of cable 12, thereby further preventing unwanted moisture from infiltrating connector body 22.

Figure 6:
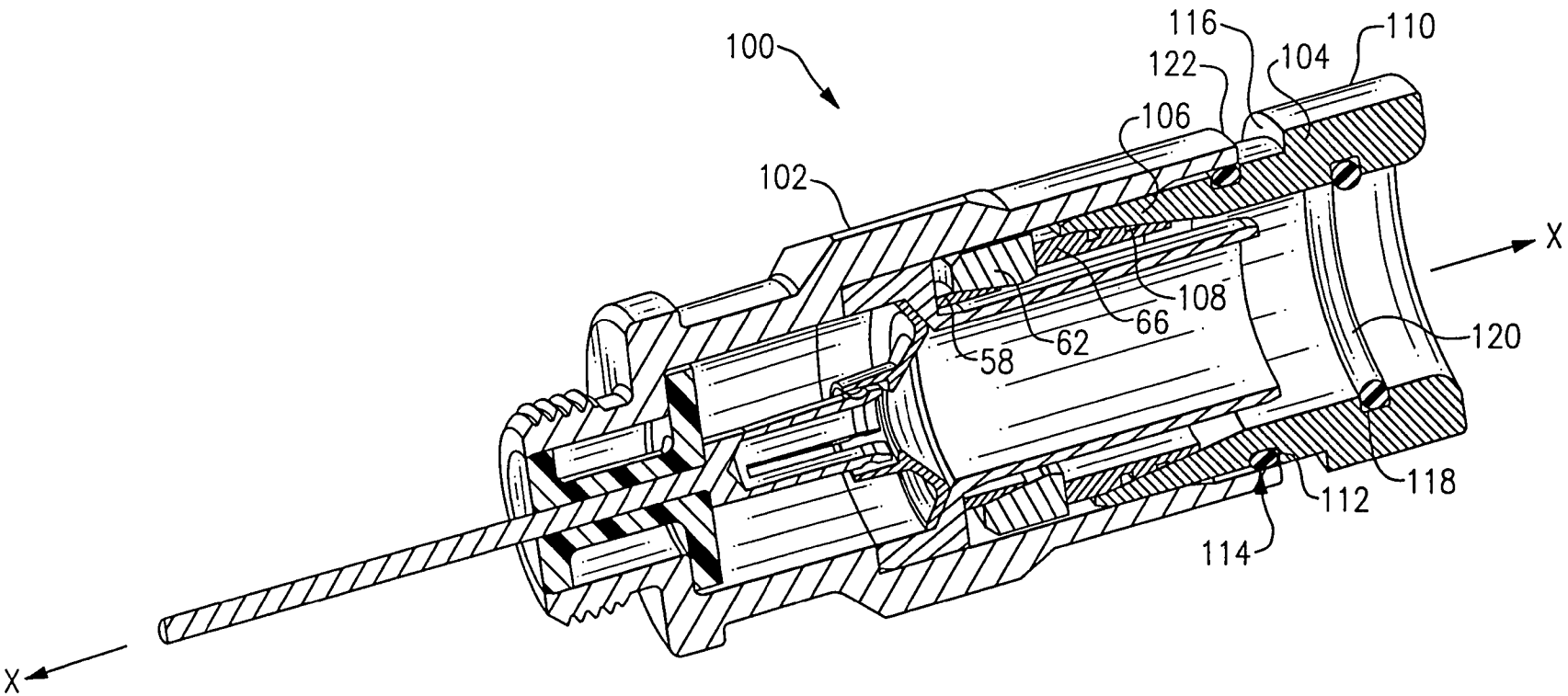
FIG. 6 is a cut-away, perspective view of a second embodiment of the connector of FIG. 1 modified for standard QR type cable, in which most of the cable jacket is left on the cable; only a little of the jacket is cut back during installation.
Figure 7:
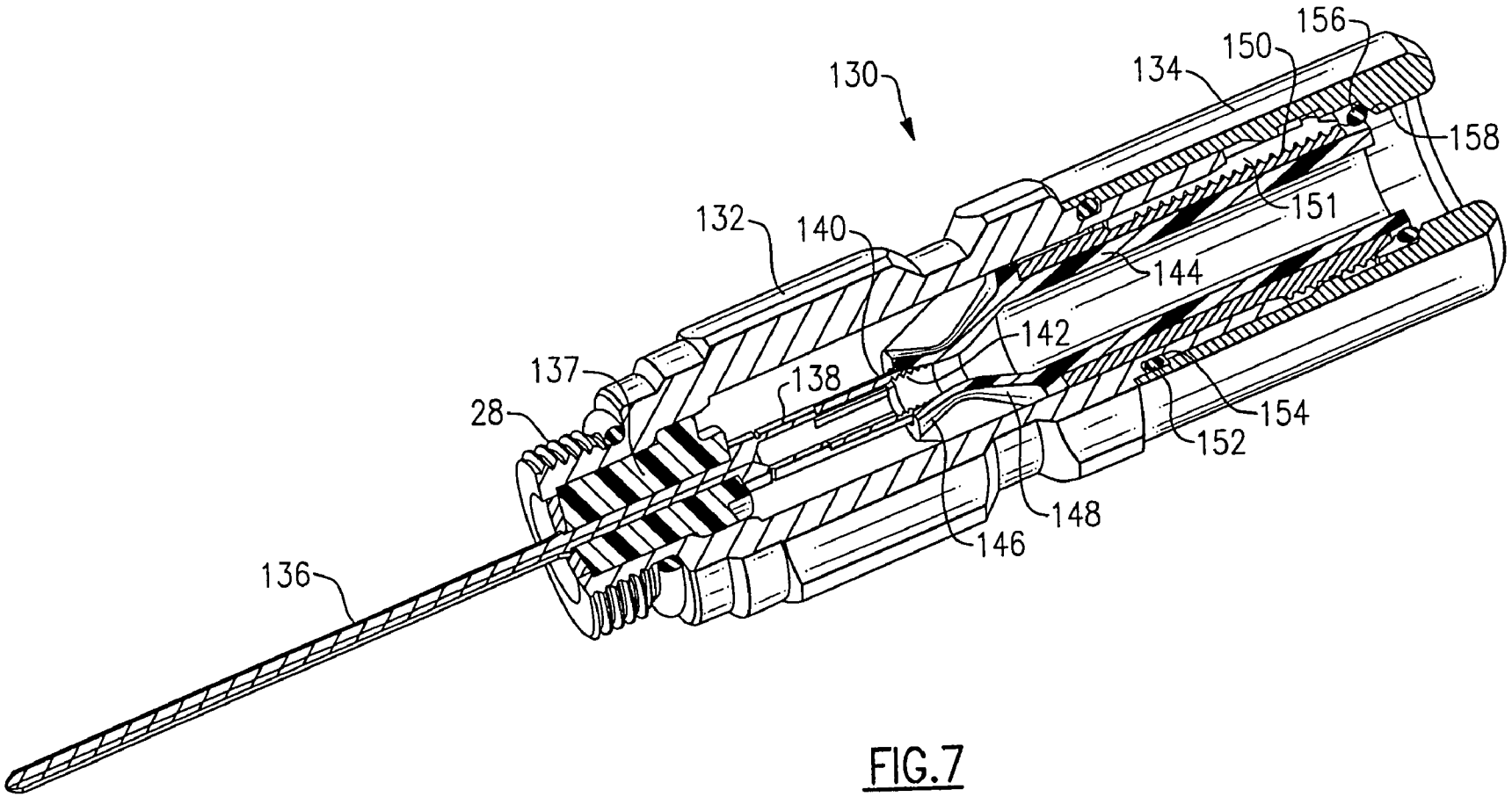
FIG. 7 is a cut-away, perspective view of a third embodiment of the present invention.

Referring to FIG. 6, a second embodiment of the present invention is shown as a pin connector 100 used in connection with QR cable. Pin connector 100 is functionally equivalent to connector 10, and includes many of the same components as used with connector 10, all of which are referenced by identical reference numerals, while those components that are modified are given new reference numerals. When using standard QR type cable, most of the cable jacket is left on the cable, with only a little of the jacket being cut back during installation. Only RF seal 58 makes electrical contact with the ground braid of the QR cable, with subsequent electrical contact being made through RF seal driver 62 and connector body 22. In this embodiment, clamping/sealing member 66 only contacts the outer sheath of the QR cable.

Pin connector 100, extending along a longitudinal axis X, includes a connector body 102 and a press fit compression body 104 that axially slides relative to connector body 102 between first (uncompressed) and second (fully compressed) positions. FIG. 6 shows connector 100 in its first position. Compression body 104 is slightly modified from compression body 24 of the first embodiment in that it includes a front body portion 106, including a tapered inner surface 108, that slides into connector body 102, and a rear body portion 110 that is of a greater diameter than front body portion 106 that does not fit within connector body 106. Front body portion 106 includes an annular groove 112 formed around its outer surface, rearward of tapered inner surface 108, in which an O-ring 114 is received to provide a seal between compression body 104 and connector body 102 when compression body 104 is moved to its second position.

A neck region 116 formed at the interface of front body portion 106 and rear body portion 110 serves as a stop that prevents compression body 104 from proceeding too far axially into connector body 102 when neck region 116 engages a rear surface 122 of connector body 102 when compression body 104 reaches its second position. Rear body portion 110 includes an annular groove 118 formed in its inner surface in which an O-ring 120 is received to serve as a seal between rear body portion 110 and outer jacket 21 of cable 12 (FIG. 5C). The remainder of pin connector 100 is functionally and structurally virtually the same as connector 10.

Referring to FIG., a third embodiment of the invention is shown as a pin connector in the closed position. A connector 130 includes a front body 132 and a back body 134. A conductive pin 136 is held within front body 132 by an insulator 137. Conductive pin 136 is electrically connected to a contact 138 which in turn is electrically connected to a collet 140. Preferably, conductive pin 136, contact 138, and collet 140 are one-piece. A plurality of teeth 142 are on an inner surface of collet 140 to provide an enhanced interference fit with the center conductor of the cable upon installation. For ease of manufacturing, teeth 142 are preferably formed as in internal threaded portion of collet 140. Portions of a mandrel 144 fit inside both front body 132 and back body 134. The portion of mandrel 144 inside front body 132 is preferably press fit inside front body 132. Mandrel 144 is preferably plastic. Mandrel 144 includes a seizing portion 146 which presses teeth 142 onto the central conductor of the cable during installation when back body 134 is moved from the open position to the closed position. Mandrel 144 also includes a bushing portion 148 which helps guide the central conductor of the cable into collet 140. A plurality of teeth 150 preferably formed as internal threads on a clamping body 151 break the oxide (aluminum oxide) on the outer conductor of the cable to ensure good electrical contact between clamping body 151 and the outer conductor of the cable. Clamping body 151 also provides the necessary RF sealing function in connector 130. An O-ring 152 inside an annular groove 154 in front body 132 provides a seal between front body 132 and back body 134. An O-ring 156, pressed into place by a neck 158 on back body 134, preferably provides a seal between connector 130 and external environmental influences.

Figure 8:
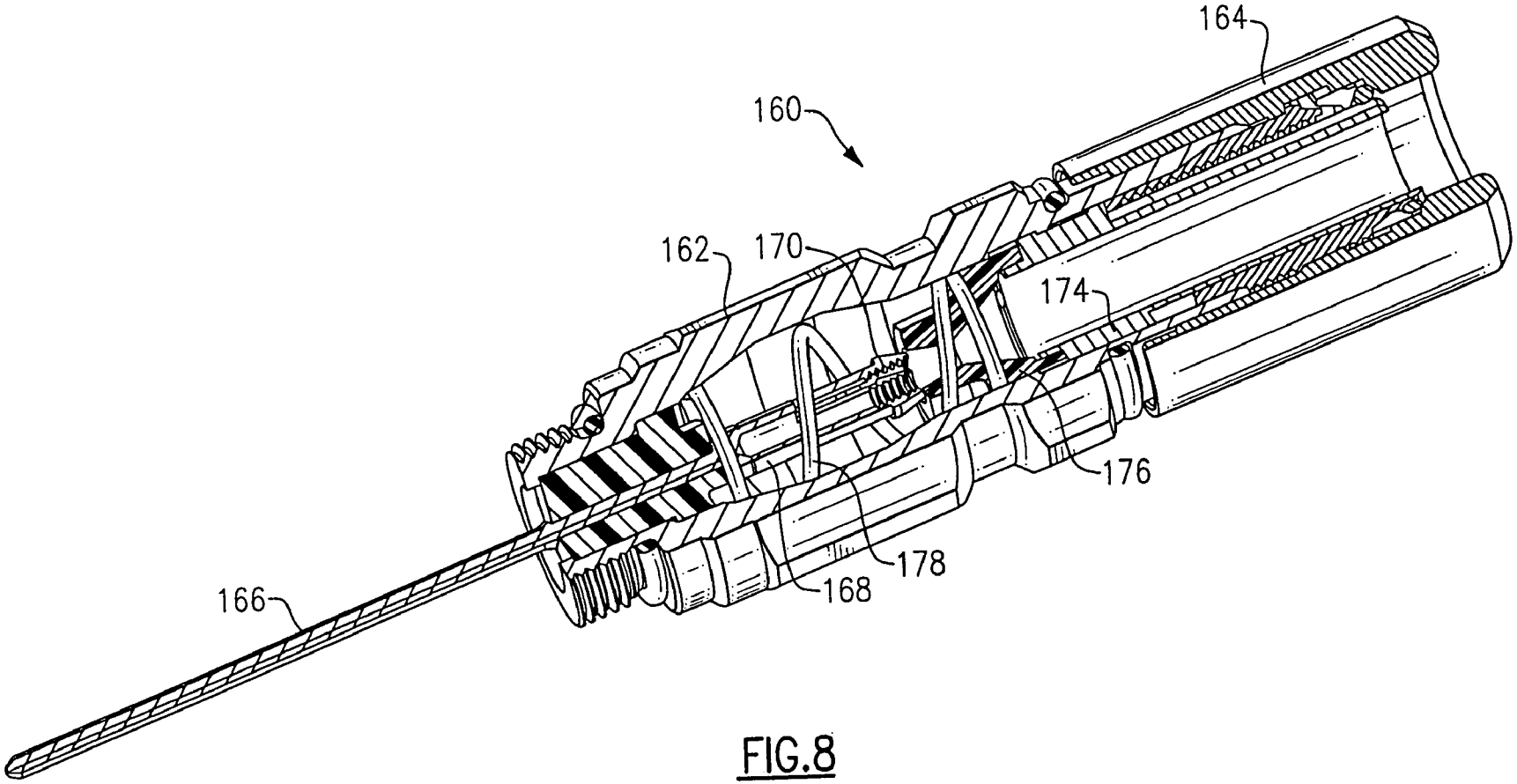
FIG. 8 is a cut-away, perspective view of a fourth embodiment of the connector of FIG. 7, shown in its open position.
Figure 9:
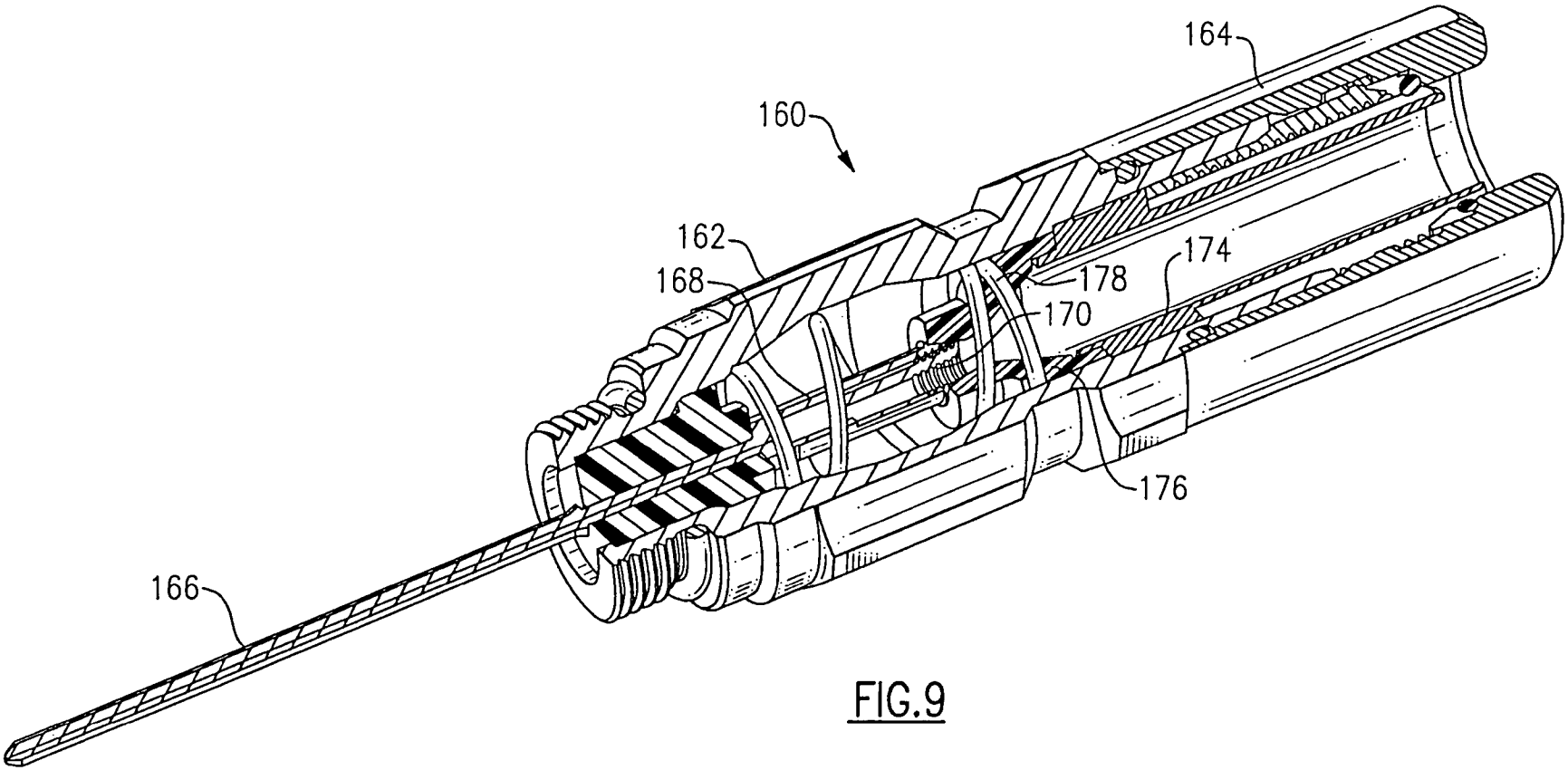
FIG. 9 is a cut-away, perspective view of the embodiment of FIG. 8 shown in its closed position.

Referring to FIGS. 8–9, a fourth embodiment of the present invention is shown. A connector 160 includes a front body 162 and a back body 164. FIG. 8 shows connector 160 in the open position, while FIG. 9 shows connector 160 in the closed position. A mandrel 174 is preferably of metal, while a separate seizure/bushing piece 176 is preferably of plastic. A collet 170 is at one end of a contact 168 with a conductive pin 166 at the other end of contact 168, as with other embodiments. In this embodiment, a spring 178 biases bushing 176 and mandrel 174 rearward to prevent mandrel 174 and bushing 176 from moving forward and closing collet 170 prematurely. The rearward bias is only overcome when an installer pushes a prepared cable end into connector 160.

Figure 10:
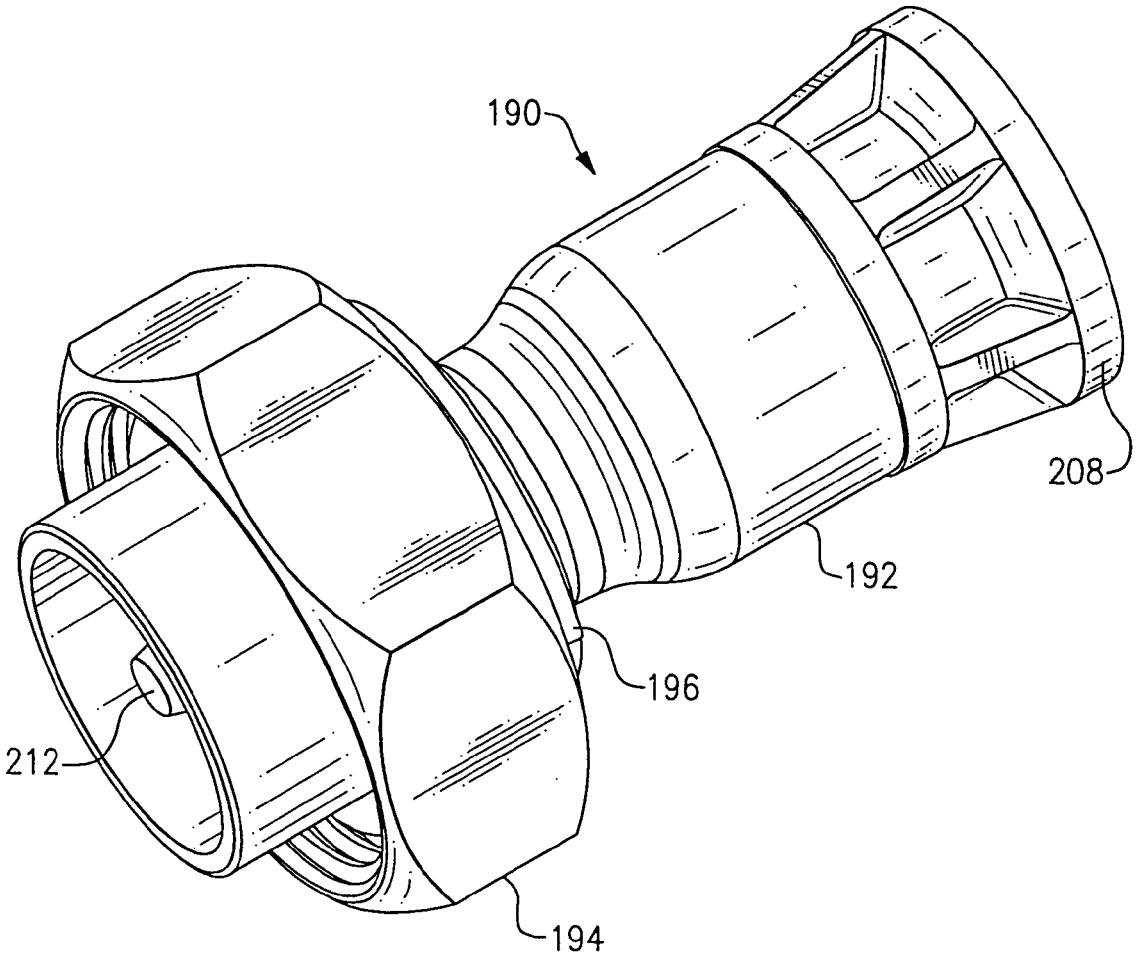
FIG. 10 is a perspective view of a fifth embodiment of the present invention for a male DIN connector.
Figure 11:
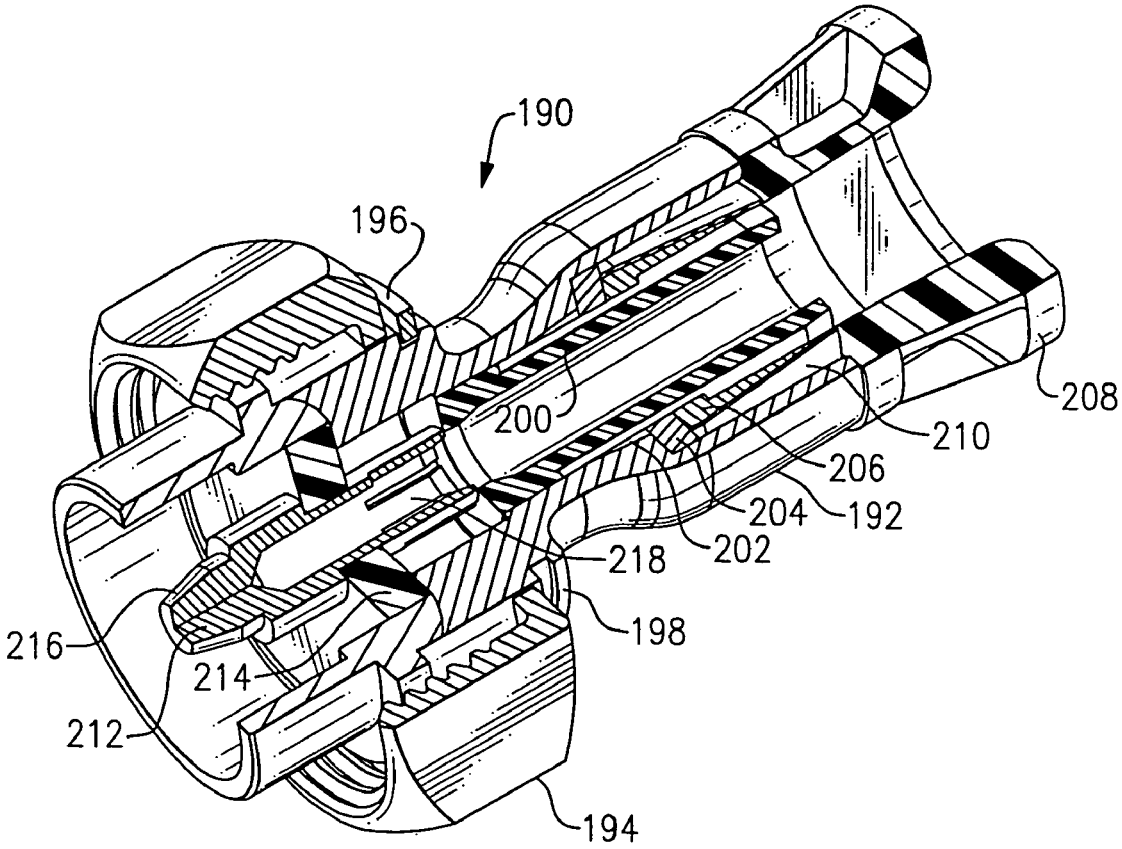
FIG. 11 is a cut-away, perspective view of the embodiment of FIG. 10.
Figure 12:
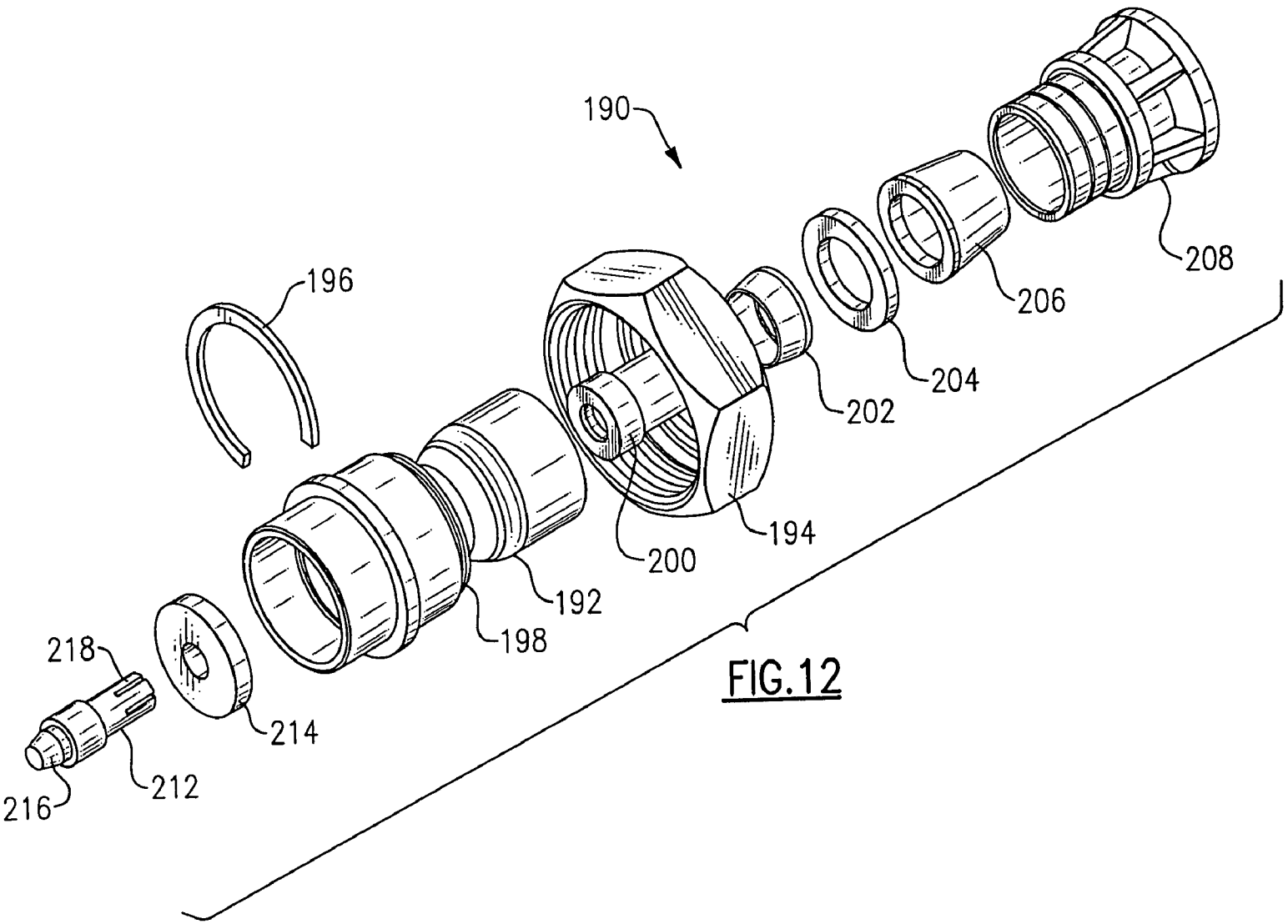
FIG. 12 is an exploded perspective view of the embodiment of FIG. 10.

Referring to FIGS. 10–12, a fifth embodiment of the present invention is shown for a male DIN connector. A connector 190 includes a body 192 into which a compression piece 208 lodges when connector 190 is in the closed position. The shape of that portion of compression piece 208 visible in FIG. 10 is of no particular significance, except that when piece 208 is injection molded plastic, as preferred, the shape is dictated by injection molding techniques. A coupling nut 194 is held in place by a nut retaining piece 196 which fits into an annular groove 198. A mandrel 200, although preferably plastic in this embodiment, could be made of metal with minor changes made to the front end of mandrel 200 to ensure that inappropriate electrical contact with a collet 212 is not made. With mandrel 200 of plastic, contact between mandrel 200 and collet 212 is not an issue. Collet 212, which includes a solid end 216 for connecting with a female DIN plug and an open end 218 for receiving the central conductor of the cable, is held in place within body 192 by an insulator 214. Insulator 214 is preferably of plastic, but any electrical insulator will work. An RF seal 202 fits around mandrel 200, with an RF seal driver 204 rearward of RF seal 202. Rearward of RF seal driver 204 is a tapered clamp 206 which is spaced apart from mandrel 200 to permit entry of the outer conductor of the cable between mandrel 200 and clamp 206 during installation. A tapered portion 210 of compression piece 208 fits around tapered clamp 206 so that clamp 206 is secured against the outer conductor of the cable when compression piece 208 is compressed forward into body 192 of connector 190.

Figure 13:
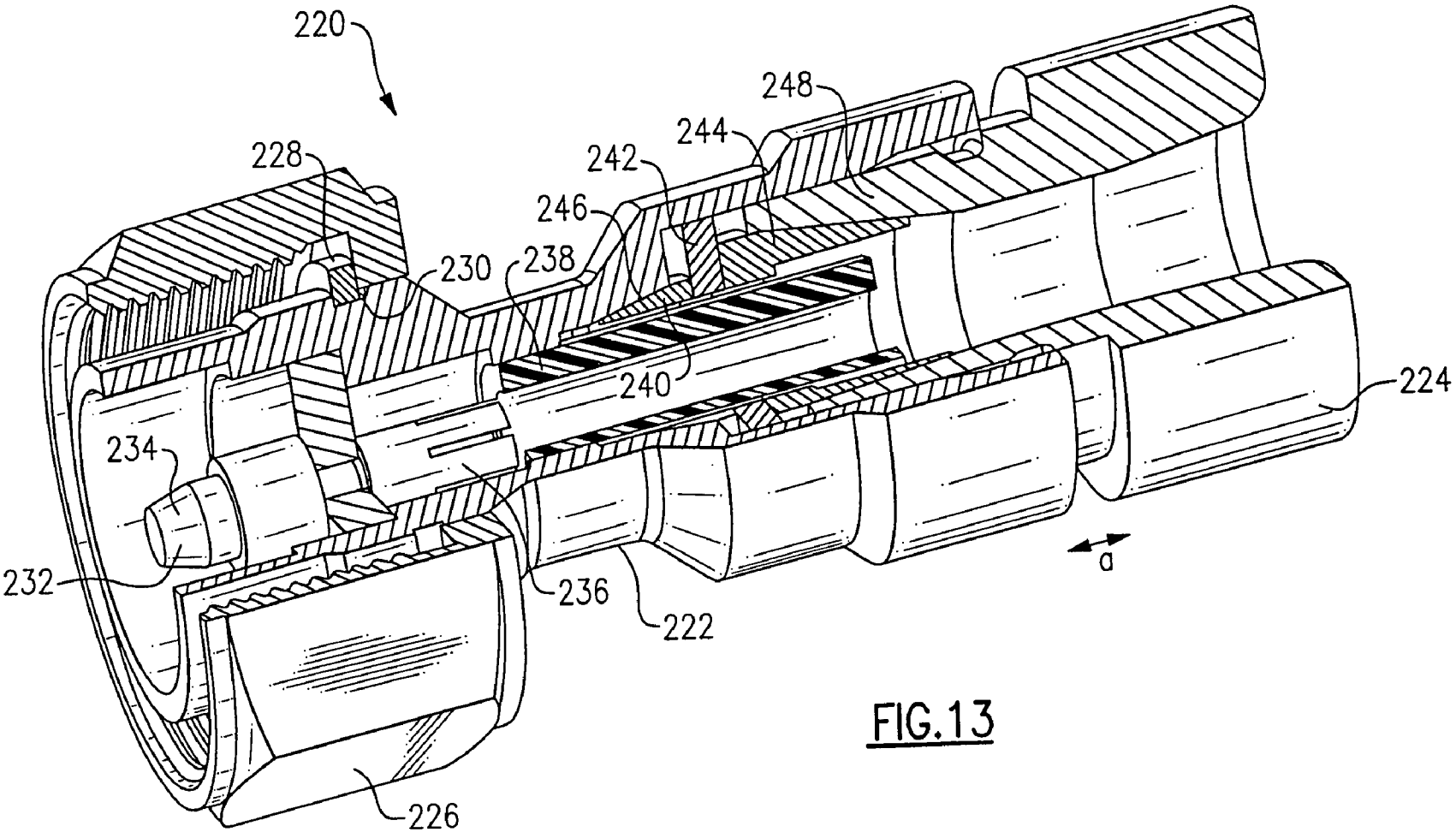
FIG. 13 is an perspective view of a sixth embodiment of the present invention.

Referring to FIG. 13, a sixth embodiment is shown which is a variation of the fifth embodiment. A connector 220 includes a front body 222 and a compression body 224. A coupling nut 226 is held in place by a nut retaining piece 228 which fits into an annular groove 230 in front body 222. A collet 232 includes a solid end 234 for connecting with a female DIN plug and an open end 236 for receiving the central conductor of the cable. A mandrel 238, made of plastic in this embodiment, serves to guide the central conductor of the cable into collet 232. An RF seal 240, an RF seal driver 242, and a clamp 244 all make contact with the outer conductor of the cable which is clamped between these three elements and mandrel 238 after installation. A ramped surface 246 is built into front body 222 in this embodiment which interacts with RF seal 240. A tapered end 248 of compression body 224 moves along clamp 244 a compression distance "a" when compression body 224 is compressed into front body 222 during installation.

Figure 14:
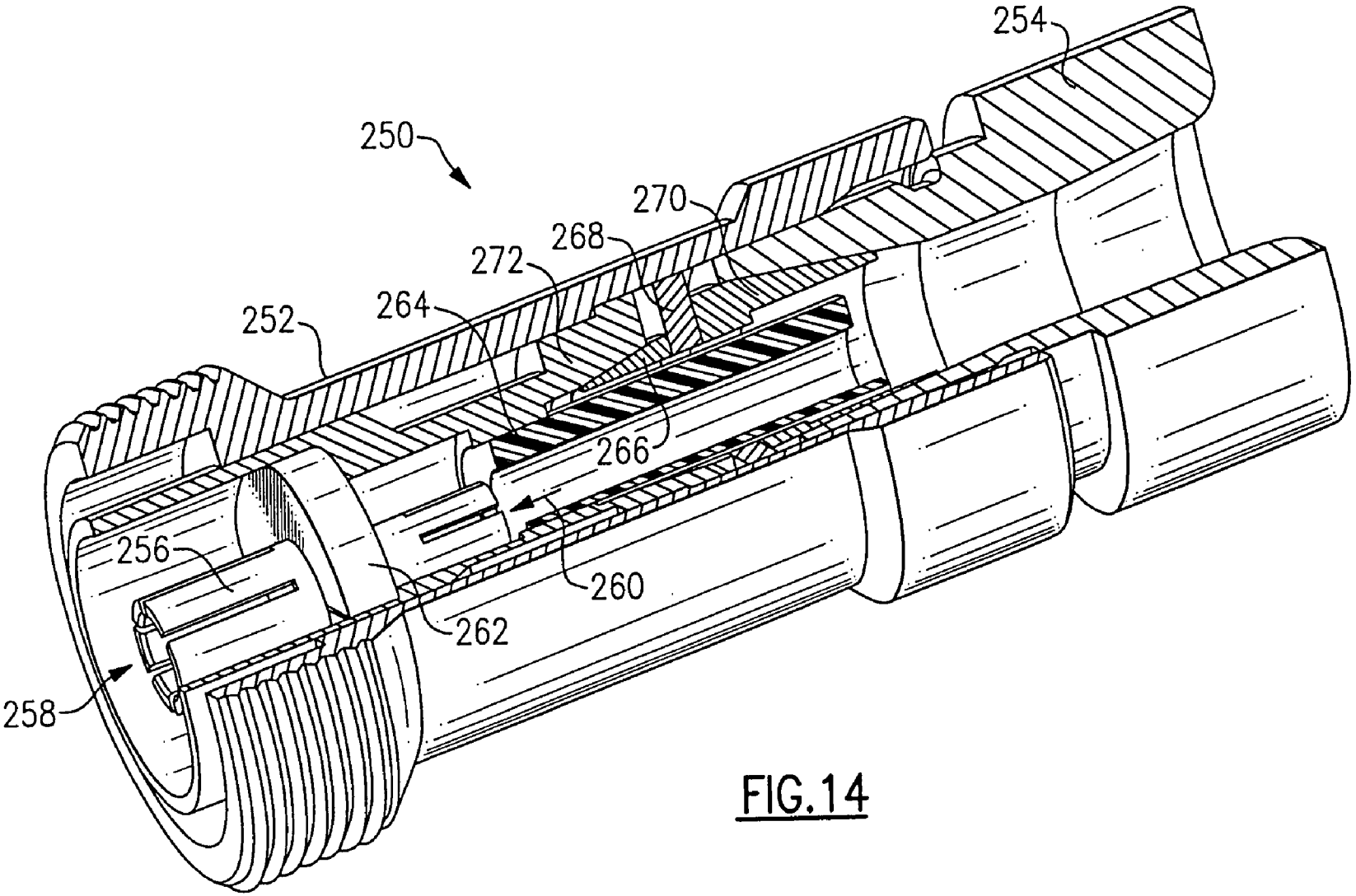
FIG. 14 is a cut-away, perspective view of a seventh embodiment of the present invention for a female DIN connector.

Referring to FIG. 14, a seventh embodiment of the present invention is shown for a female DIN connector 250. A front body 252 houses a collet 256 which is held in place by an insulator 262. A first end 258 of collet 256 provides the female connection for a male DIN connector, while a second end 260 of collet 256 provides the connection for the center conductor of the cable being connected. A plastic mandrel 264 guides the center conductor of the cable into collet 256. A ground conducting portion 272 of front body 252 provides electrical contact with the outer conductor of the cable being connected as when the outer conductor is sandwiched between mandrel 264 and the combination of RF seal 266, RF seal driver 268, and clamp 270. A compression body 254 drives RF seal 266, RF seal driver 268, and clamp 270 forward as previously described in other embodiments.

Figure 15:
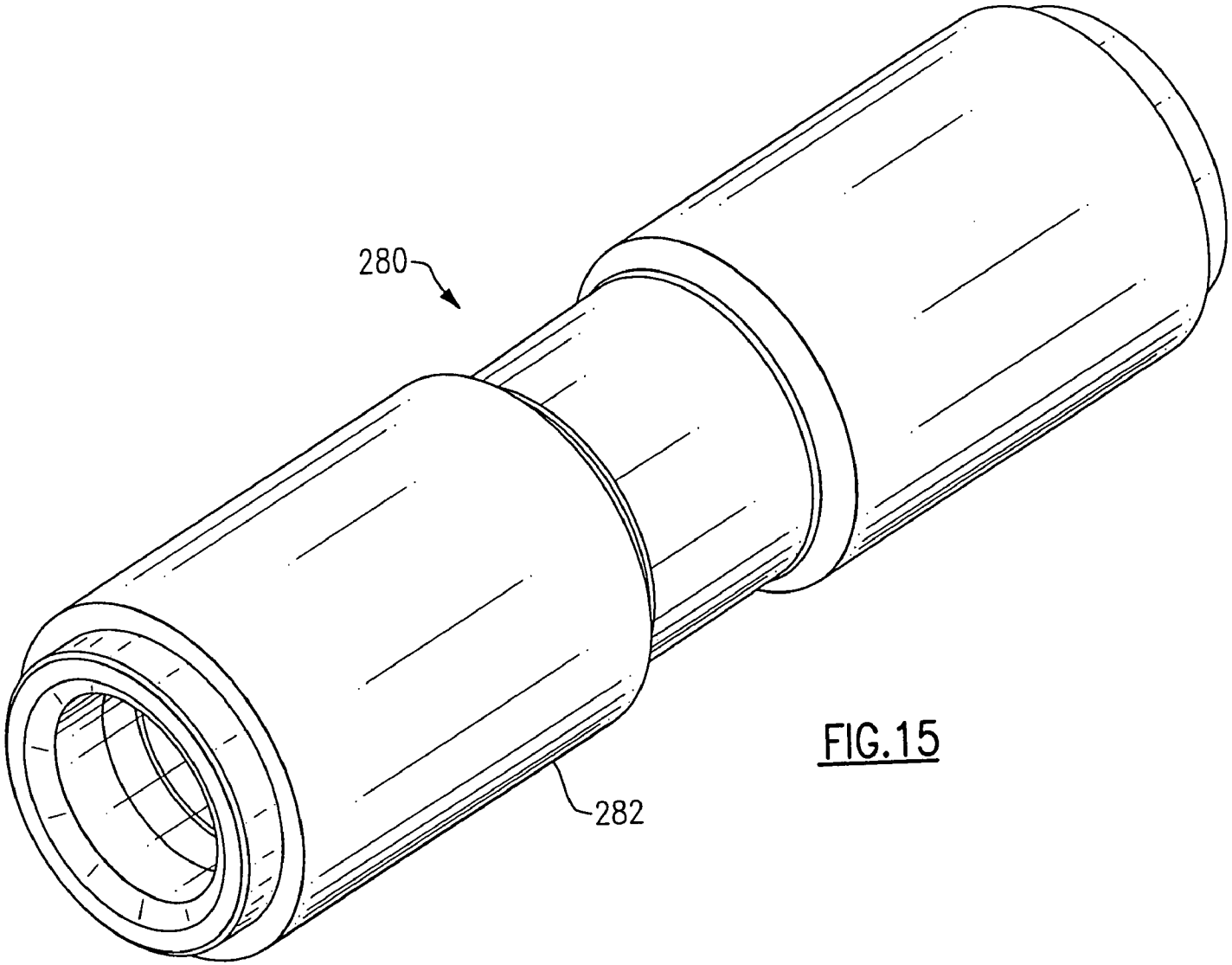
FIG. 15 is a perspective view of a splice connector that uses the connecting members of the pin connector of FIG. 1.
Figure 16:
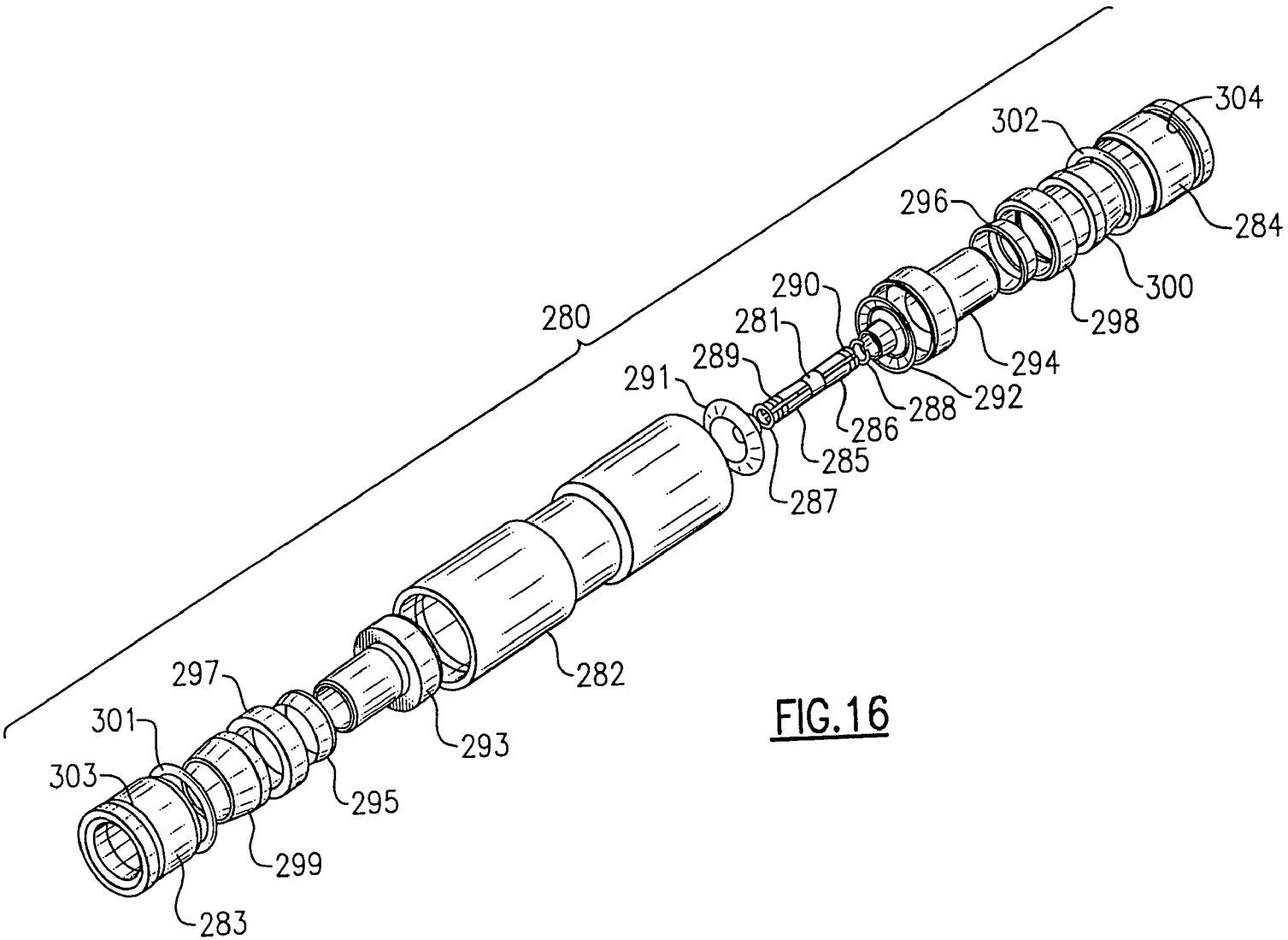
FIG. 16 is an exploded perspective view of the splice connector of FIG. 15.

Referring to FIGS. 15–19, an eighth embodiment of the present invention is shown, in which the connecting members of the first embodiment are used to form a splice connector 280. The exterior of connector 280 is shown in FIG. 15. FIG. 16 shows an exploded view of connector 280. A connector body 282 houses two sets of sealing elements. A contact piece 281 includes a collet 285 on one end and a collet 286 on the other end. An O-ring 287 fits in an annular groove 289 in collet 285. A centering guide 291 is adjacent collet 285, which in turn is adjacent a mandrel 293. Centering guide 291 guides the center conductor from a cable being connected into collet 285. Mandrel 293 aids the guiding process and also provides a surface against which the outer conductor from the cable being connected is secured by an RF seal 295, an RF seal driver 297, and a clamp 299. A compression body 283 forms a compression fit with RF seal 295, RF seal driver 297, and clamp 299 to hold the cable end securely in place when compression body 283 is in the closed position. An O-ring 301 fits into an annular groove 303 to seal the cable end from external elements. In similar fashion, an O-ring 288 fits in an annular groove 290 in collet 286. A centering guide 292 is adjacent collet 286, which in turn is adjacent a mandrel 294. Centering guide 292 guides the center conductor from a cable being connected into collet 286. Mandrel 294 aids the guiding process and also provides a surface against which the outer conductor from the cable being connected is secured by an RF seal 296, an RF seal driver 298, and a clamp 300. A compression body 284 forms a compression fit with RF seal 296, RF seal driver 298, and clamp 300 to hold the cable end securely in place when compression body 284 is in the closed position. An O-ring 302 fits into an annular groove 304 to seal the cable end from external elements.

Figure 17:
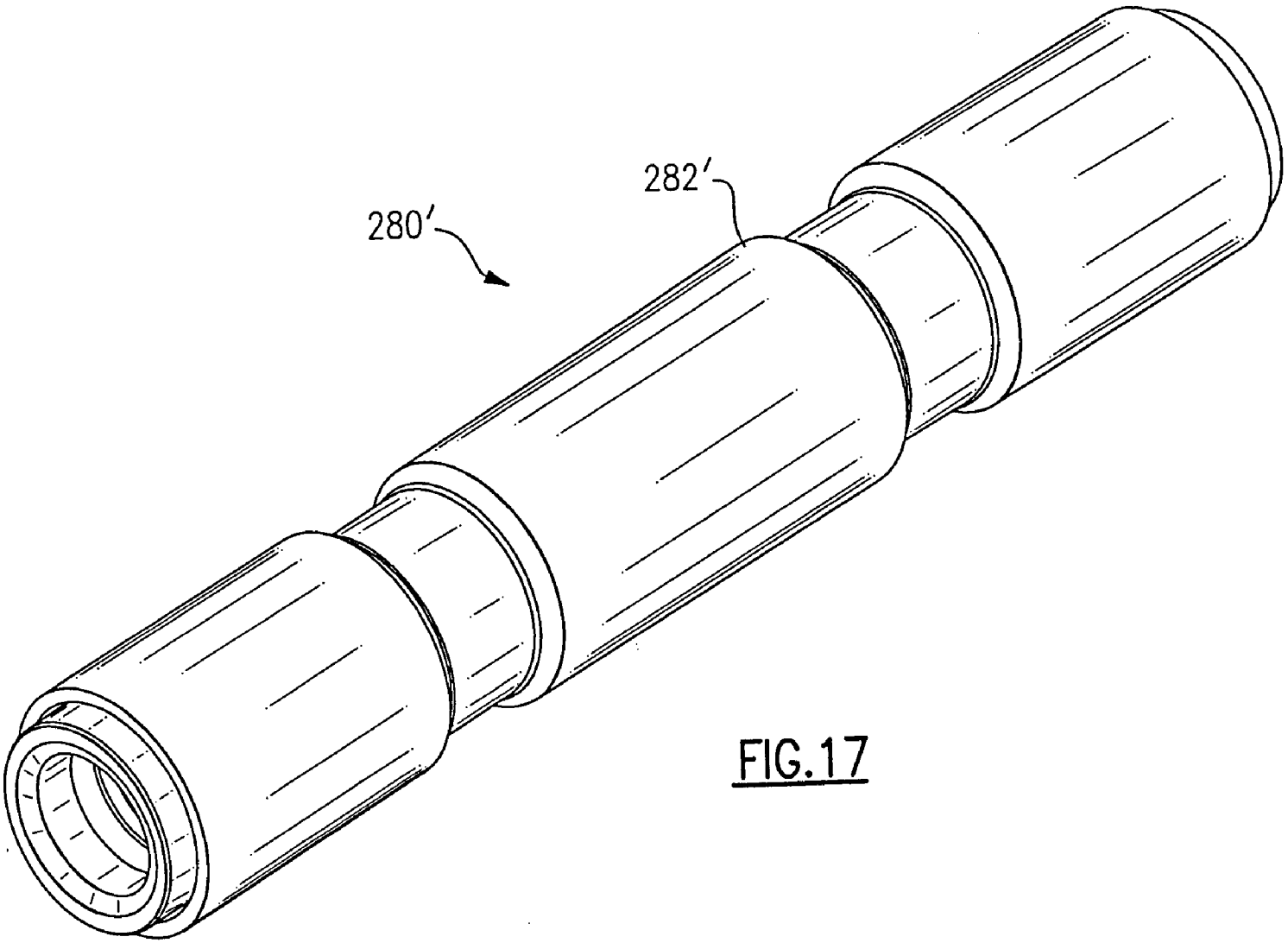
FIG. 17 is a perspective view of the splice connector of FIG. 15 modified to have an extended central body.

FIG. 17 shows a splice connector 280' which is identical to splice connector 280 except that it includes an extended body 282' instead of a regular body 282. During installation, if the existing free cable needing to be connected is too short because of an installer cutting away a previously attached connector, and consequently shortening the cable, the extended body 282' of splice connector 280' is used.

Figure 18:
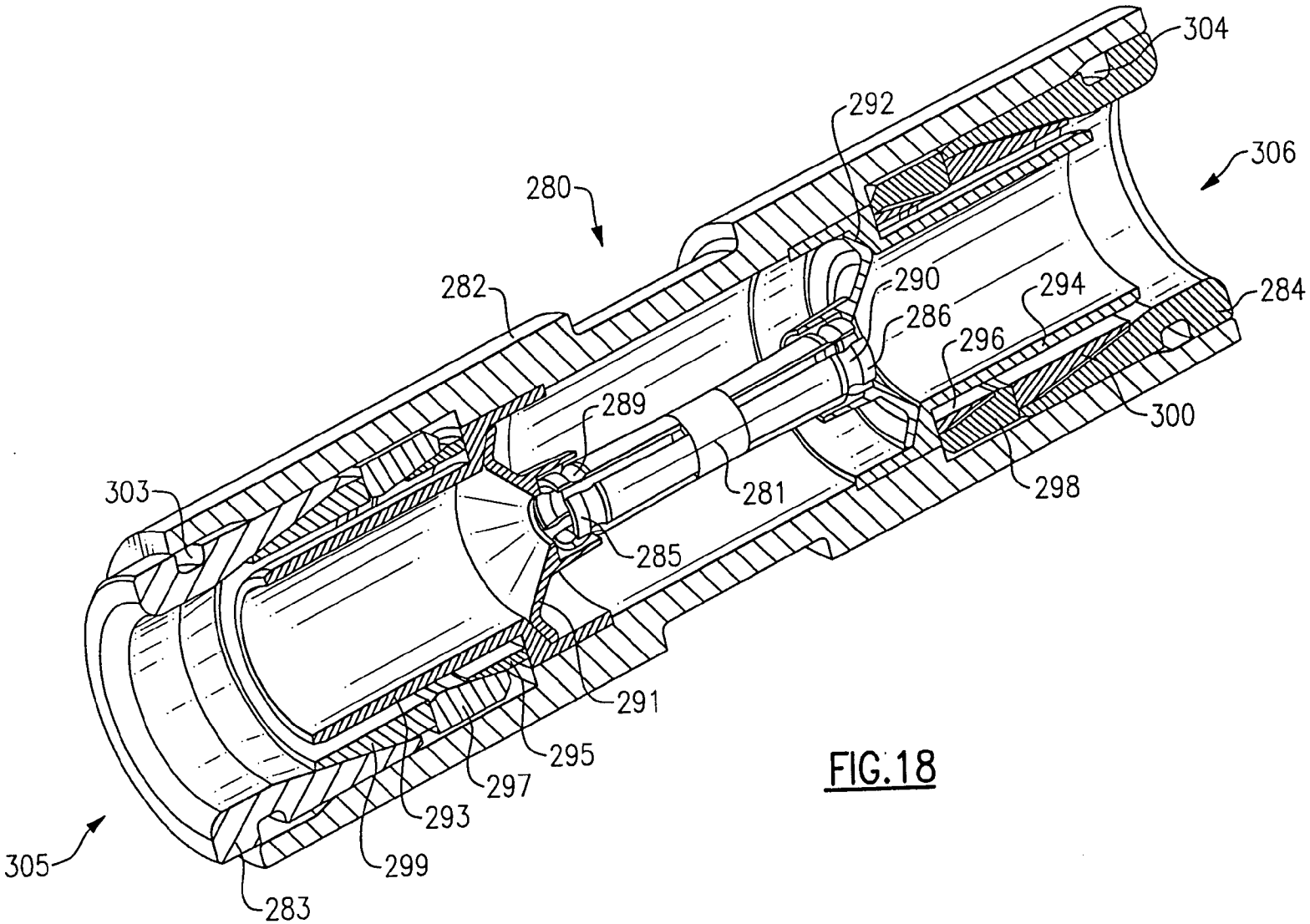
FIG. 18 is a cut-away, perspective view of the splice connector of FIG. 15.
Figure 19:
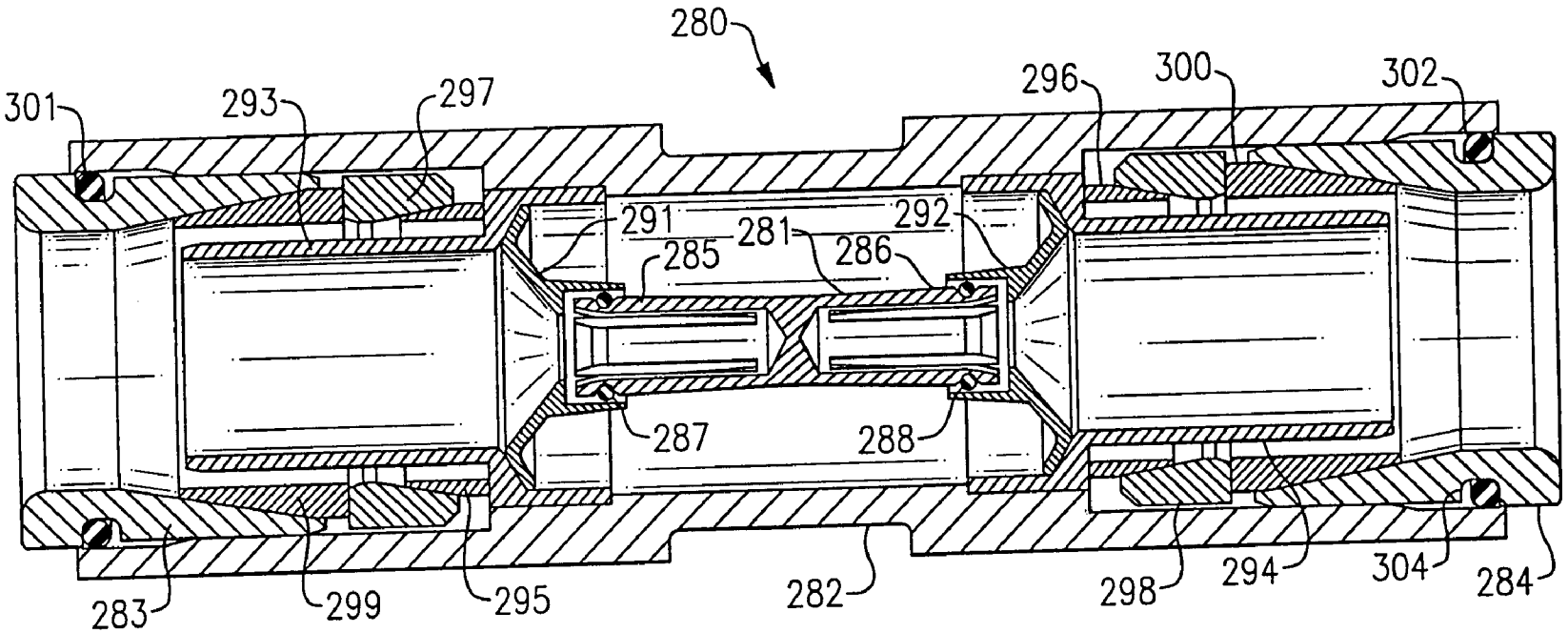
FIG. 19 is a longitudinal cross-sectional view of the splice connector of FIG. 15.

FIGS. 18–19 show different views of the splice connector of the eighth embodiment. A first cable is connected at a first end 305, while a second cable is connected at a second end 306. The first and second cables are thus electrically connected to each other.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A device for interconnecting a hard-line coaxial cable to a connection housing, wherein said coaxial cable includes at least a central conductor, a layer of dielectric material covering the central conductor, and an outer conductor composed of hard-line material, said device comprising:

a connector body extending along a longitudinal axis;

a contact interconnected to and extending coaxially through said connector body;

for receiving said central conductor of said coaxial cable;

a compression body positioned radially adjacent a portion of said connector body for sliding axial movement relative thereto between first and second positions, wherein when said compression body is in its first position, said coaxial cable is removable from within said device;

a mandrel housed within said connector body; and a sealing member housed within said connector body in continuous sealing relation to said outer conductor when said compression body is in its second position.

2. A device according to claim 1, further comprising a clamping member housed within said connector body, wherein a tapered surface of said clamping member directly engages a tapered surface of said compression body when said compression body is in its second position.

3. A device according to claim 2, further comprising a driving member housed within said connector body in ordered relationship between said clamping member and said sealing member such that when said compression body is moved from its first position to its second position, said compression body forces said clamping member against said driving member, and said driving member against said sealing member.

4. A device according to claim 3, further comprising a tapering surface on said sealing member which interacts with a tapering surface on said driving member by deforming said sealing member radially inward when said compression body is moved from its first position to its second position.

5. A device according to claim 4, wherein a radial distance between an inner diameter of said sealing member and an outer diameter of said mandrel is substantially equal to a radial distance between an inner diameter of said clamping member and said outer diameter of said mandrel.

6. A device according to claim 4, wherein said connector body is elongated beyond an amount required to contain said contact, said centering guide, said mandrel, said sealing member, said driving member, said clamping member, and said compression body.

7. A device according to claim 4, further comprising means for connecting said device to said connection housing, wherein said contact includes a conductive pin, and said connection housing is an equipment port.

8. A device according to claim 4, further comprising means for connecting said device to said connection housing, wherein said contact includes a solid end opposite said contact, and said connection housing is a male DIN connector.

9. A device according to claim 4, further comprising means for connecting said device to said connection housing, wherein said contact includes first and second collets, and said connection housing is a female DIN connector.

10. A device according to claim 4, further comprising means for connecting said device to said connection housing, wherein said connection housing is a hardline coaxial cable.

11. A device according to claim 4, wherein said portion of said compression body radially adjacent said connector body is inside said connector body.

12. A device according to claim 4, wherein a radial distance between an inner diameter of said sealing member and an outer diameter of said mandrel is less than a radial distance between an inner diameter of said clamping member and said outer diameter of said mandrel.

13. A device according to claim 12, further comprising:

a first annular groove in an outer surface of said compression body;

a second annular groove in an inner surface of said compression body;

a first O-ring in said first annular groove; and a second O-ring in said second annular groove, wherein when said compression body is in its second position, said first O-ring forms a seal between said compression body and said connector body and said second O-ring form a a seal between said compression body and said coaxial cable.

14. A device according to claim 4, further comprising a centering guide having a first portion coupled to said contact and a second portion engaging a portion of said mandrel, and having a third portion between said first and second portions which guides said central conductor into said contact upon insertion of said central conductor into said connector body.

15. A device according to claim 14, further comprising:

an annular groove in an outer surface of said compression body; and an O-ring in said annular groove, wherein when said compression body is in its second position, said O-ring forms a seal between said compression body and said connector body.

16. A device according to claim 4, wherein said portion of said compression body radially adjacent said connector body is outside said connector body.

17. A device according to claim 16, wherein said mandrel includes a tapered end coupled to said contact and a bushing which guides said central conductor into said contact upon insertion of said central conductor into said connector body.

18. A device according to claim 16, further comprising a seizure/bushing member with a seizing end coupled to said contact and a bushing end coupled to said mandrel, wherein said bushing guides said central conductor into said contact upon insertion of said central conductor into said connector body.

19. A device according to claim 18, further comprising a spring inside said connector body which biases said seizure/bushing member away from said contact.

20. A device for interconnecting a hard-line coaxial cable to a connection housing, wherein said coaxial cable includes at least a central conductor, a layer of dielectric material covering the central conductor, and an outer conductor composed of hard-line material, said device comprising:

a connector body extending along a longitudinal axis;

a contact interconnected to and extending coaxially through said connector body;

for receiving said central conductor of said coaxial cable;

a compression body positioned radially adjacent a portion of said connector body for sliding axial movement relative thereto between first and second positions, wherein when said compression body is in its first position, said coaxial cable is removable from within said device;

a mandrel housed within said connector body; and means for clamping and/or sealing said outer conductor to said mandrel.

21. A splice connector for interconnecting two hard-line coaxial cables, wherein each coaxial cable includes at least a central conductor, a layer of dielectric material covering the central conductor, and an outer conductor composed of hard-line material, said connector comprising:

a connector body extending along a longitudinal axis;

a contact interconnected to and extending coaxially through said connector body;

for receiving said central conductors of said coaxial cables;

first and second compression bodies positioned radially adjacent first and second portions of said connector body for sliding axial movement relative thereto between first and second positions, wherein when each compression body is in its first position, said coaxial cables are removable from within said splice connector;

first and second mandrels housed within said connector body; and first and second sealing members housed within said connector body in continuous sealing relation to said respective outer conductor when said compression bodies are in their second position.

22. A splice connector for interconnecting two hard-line coaxial cables, wherein each coaxial cable includes at least a central conductor, a layer of dielectric material covering the central conductor, and an outer conductor composed of hard-line material, said connector comprising:

a connector body extending along a longitudinal axis;

a contact interconnected to and extending coaxially through said connector body;

for receiving said central conductors of said coaxial cables;

first and second compression bodies positioned radially adjacent first and second portions of said connector body for sliding axial movement relative thereto between first and second positions, wherein when each compression body is in its first position, said coaxial cables are removable from within said splice connector;

first and second mandrels housed within said connector body; and means for clamping and/or sealing said outer conductors to respective ones of said mandrels.

* * * * *